US011139599B2

(12) United States Patent
Zhang et al.

(10) Patent No.: US 11,139,599 B2
(45) **Date of Patent: *Oct. 5, 2021**

(54) ELECTRICAL CONNECTOR AND ELECTRICAL CONNECTOR ASSEMBLY WITH THE SAME

(71) Applicant: ALLTOP ELECTRONICS (SUZHOU) LTD., Suzhou (CN)

(72) Inventors: Zhihui Zhang, Suzhou (CN); Dingbin Yin, Suzhou (CN)

(73) Assignee: ALLTOP ELECTRONICS (SUZHOU) LTD., Suzhou (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/033,344

(22) Filed: Sep. 25, 2020

(65) Prior Publication Data

US 2021/0013654 A1 Jan. 14, 2021

Related U.S. Application Data

(63) Continuation of application No. 16/571,015, filed on Sep. 13, 2019, now Pat. No. 10,826,215.

(30) Foreign Application Priority Data

| | | |
|---|---|---|
| Sep. 25, 2018 | (CN) | 201811119375.4 |
| Mar. 6, 2019 | (CN) | 201910166055.2 |
| Aug. 5, 2019 | (CN) | 201910716350.0 |

(51) Int. Cl.
*H01R 13/04* (2006.01)
*H01R 4/02* (2006.01)
(Continued)

(52) U.S. Cl.
CPC ..... *H01R 13/04* (2013.01); *H01R 4/025* (2013.01); *H01R 4/625* (2013.01); *H01R 4/70* (2013.01); *H01R 2107/00* (2013.01)

(58) Field of Classification Search
CPC ... H01R 13/115; H01R 13/113; H01R 13/112; H01R 13/11; H01R 13/187; H01R 13/04;
(Continued)

(56) References Cited

U.S. PATENT DOCUMENTS

| | | | | |
|---|---|---|---|---|
| 4,734,042 A * | 3/1988 | Martens | H01R 12/721 361/785 |
| 5,795,196 A * | 8/1998 | Hotea | H01R 13/18 439/850 |

(Continued)

*Primary Examiner* — Gary F Paumen
(74) *Attorney, Agent, or Firm* — Cheng-Ju Chiang

(57) ABSTRACT

An electrical connector includes an insulative housing and a plurality of power contact pairs. The insulative housing has a plurality of contact-receiving passageways extending along a front-and-back direction. The power contact pairs are mounted in the corresponding contact-receiving passageways and divided into two opposite rows in a height direction according to contacting portions. Each power contact pair in each row has a first power contact and a second power contact, each one of the first power contact and the second power contact defines a flaky retaining portion held in the relative contact-receiving passageway and a number of contacting portions extending forwards from a front end of the retaining portion. A gap is formed between two adjacent contacting portions of the first power contact, and at least a part of one contacting portion of the second power contact extends through the gap of the first power contact.

20 Claims, 22 Drawing Sheets

(51) Int. Cl.
*H01R 4/70* (2006.01)
*H01R 4/62* (2006.01)
*H01R 107/00* (2006.01)

(58) Field of Classification Search
CPC ..... H01R 4/025; H01R 4/70; H01R 4/625; H01R 2107/00
USPC ..... 439/850, 856, 857, 845
See application file for complete search history.

(56) References Cited

U.S. PATENT DOCUMENTS

| | | | | |
|---|---|---|---|---|
| 6,102,754 | A * | 8/2000 | Capper | H01R 13/113 439/517 |
| 6,652,322 | B2 * | 11/2003 | Ito | H01R 12/721 439/637 |
| 7,892,050 | B2 * | 2/2011 | Pavlovic | H01R 13/112 439/839 |
| 8,057,263 | B1 * | 11/2011 | Howard | H01R 12/721 439/631 |
| 8,182,299 | B2 * | 5/2012 | Schrader | H01R 13/18 439/857 |
| 10,826,215 | B2 * | 11/2020 | Zhang | H01R 13/04 |
| 2002/0193019 | A1 * | 12/2002 | Blanchfield | H01R 12/58 439/857 |
| 2005/0014423 | A1 * | 1/2005 | Roepke | H01R 13/112 439/856 |
| 2009/0088028 | A1 * | 4/2009 | Ngo | H01R 13/112 439/682 |
| 2014/0227915 | A1 * | 8/2014 | Glick | H01R 13/113 439/856 |

* cited by examiner

ELECTRICAL CONNECTOR AND ELECTRICAL CONNECTOR ASSEMBLY WITH THE SAME

CROSS REFERENCE TO RELATED APPLICATIONS

The present application is a continuation application of U.S. patent application Ser. No. 16/571,015 filed on Sep. 13, 2019, the content of which is hereby incorporated by reference into this application.

BACKGROUND OF THE INVENTION

1. Field of the Invention

The present invention relates to an electrical connector and an electrical connector assembly, and more particularly to an electrical connector and an electrical connector assembly preventing contacts thereof heating effectively.

2. Description of Related Art

Each power contact of a traditional electrical connector comprises at least one contacting arm forming on a front end of a metallic sheet, however when the electric connector transmits current, the highest temperature position of its power contact is the contacting area of the contact arm, and as the contacting mean of the contacting area is only a linear contacting, the current channel is limited. In the case of the power contact has a limited width, the power contact is prone to generate heat due to current impedance, thereby resulting in high temperature at the contacting area.

Hence, it is desired to provide an electrical connector and an electrical connector assembly with the same to overcome the problems mentioned above.

BRIEF SUMMARY OF THE INVENTION

Accordingly, an object of the present invention is to provide an electrical connector and an electrical connector assembly preventing contacts thereof heating effectively.

The present invention is directed to an electrical connector comprising an insulative housing and a plurality of power contact pairs. The insulative housing has a plurality of contact-receiving passageways extending along a front-and-back direction. The power contact pairs are mounted in the corresponding contact-receiving passageways of the insulative housing and divided into two opposite rows in a height direction according to contacting portions. Each power contact pair in each row has a first power contact and a second power contact, each one of the first power contact and the second power contact defines a flaky retaining portion held in the relative contact-receiving passageway and a number of contacting portions extending forwards from a front end of the retaining portion. A gap is formed between two adjacent contacting portions of the first power contact, and at least a part of one contacting portion of the second power contact extends through the gap of the first power contact.

The present invention is also directed to an electrical connector assembly comprising an insulative housing and a plurality of power contact pairs. The insulative housing has a plurality of contact-receiving passageways extending along a front-and-back direction. The power contact pairs are mounted in the corresponding contact-receiving passageways, and each power contact pair has two power contacts, each power contact defines a flaky retaining portion held in the relative contact-receiving passageway, a number of contacting portions extending forwards from the retaining portion and a soldering portion extending from a rear end of the retaining portion. One of two neighboring contacting portions has a projection on a vertical plane at least partially overlapped with that of the other of two neighboring contacting portions.

The present invention is also directed to an electrical connector assembly comprising an insulative housing and a plurality of power contact pairs. The insulative housing has two rows of contact-receiving passageways separating from each other via a transverse interval wall, and each contact-receiving passageway extends along a front-and-back direction. The power contact pairs are mounted in the corresponding contact-receiving passageways, and each power contact pair has two power contacts, each power contact defines a flaky retaining portion held in the relative contact-receiving passageway, a number of contacting portions extending forwards from the retaining portion and a soldering portion extending from a rear end of the retaining portion, each contacting portion having a contacting area protruding towards the interval wall. The contacting areas of the two power contacts in each power contact pair are arranged in a misaligned relationship along the front-and-back direction.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
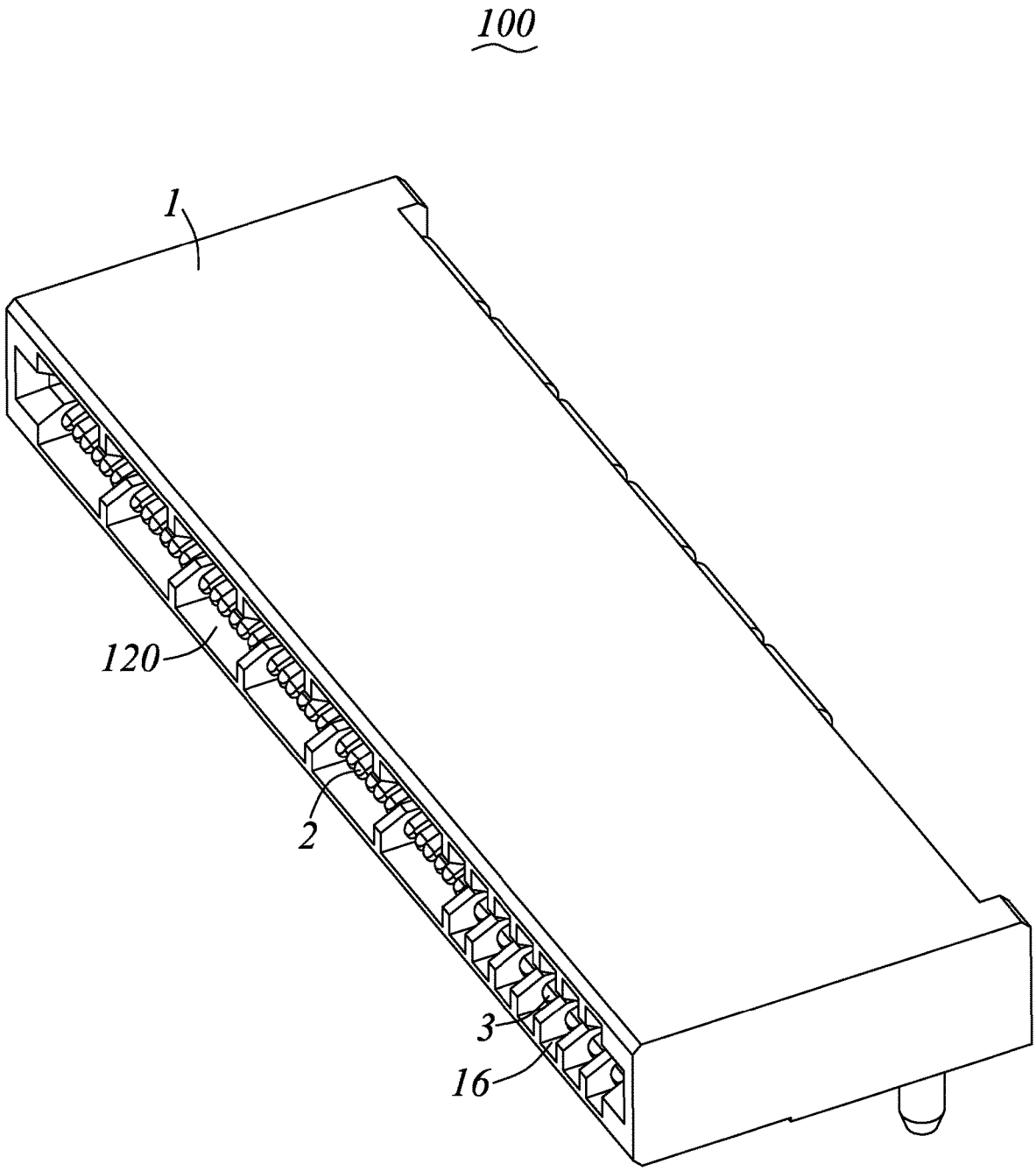
FIG. 1 is an assembled perspective view of an electrical connector in accordance with a first embodiment of the present invention.

Reference will be made to the drawing figures to describe the present invention in detail, wherein depicted elements are not necessarily shown to scale and wherein like of similar elements are designated by same or similar reference numeral through the several views and same or similar terminology.

FIGS. 1-9 illustrate an electrical connector 100 according to a first embodiment of the present invention, and the electrical connector 100 comprises an insulative housing 1 and a plurality of power contact pairs 2 held in the insulative housing 1. In order to express convenience, hereinafter, a mating end of the electrical connector 100 is defined as a front end and another end opposite to the mating end is defined as a rear end, that is to say, a front-and-back direction (also can be called a longitudinal direction) is same as the plugging direction of the electrical connector 100 mating with a complementary member (not shown). At the same time, one direction perpendicular to the front-and-back direction is called as a transverse direction, and another direction perpendicular to the front-and-back direction is called as a height direction. In this case, the insulative housing 1 has a larger dimension in the transverse direction than in the height direction and the front-and-back direction.

As illustrated in FIGS. 1 to 4 and FIGS. 8-9, in this case, the insulative housing 1 has a main section 11 used for mounting on a printed circuit board, a mating section 12 extending forwardly from the main section 11, a plurality of first contact-receiving passageways 13 extending along the front-and-back direction and a plurality of barriers 14 extending along the front-and-back direction. One barrier 14 is arranged between each two neighboring first contact-receiving passageways 13 in the transverse direction. Each first contact-receiving passageway 13 is penetrating through the insulative housing 1 along the front-and-back direction, and each barrier 14 extends forwards from the main section 11 to a front end 121 of the mating section 12.

The mating section 12 defines a mating cavity 120 opening forwards to receive the complementary member, and the first contact-receiving passageways 13 are communicated with the mating cavity 120.

In this embodiment, the insulative housing 1 defines two rows of first contact-receiving passageways 13 and an interval wall 15 between two rows of first contact-receiving passageways 13. Two rows of first contact-receiving passageways 13 include an upper row of first contact-receiving passageways 13 and a lower row of first contact-receiving passageways 13. The interval wall 15 is extending along the transverse direction and formed in the main section 11, thus to separate the upper row of first contact-receiving passageways 13 from the lower row of first contact-receiving passageways 13. Further, the interval wall 15 extends forwards to a front surface of the main section 11, but does not extend forwards into the mating section 12.

The main section 11 has a first mounting face 111, a second mounting face 112 and a third mounting face 113 at the back side thereof, the first mounting face 111, the second mounting face 112 and the third mounting face 113 are spaced apart from each other along the front-and-back direction. Herein, the third mounting face 113, the second mounting face 112 and the first mounting face 111 are sequentially arranged along a front-to-back direction.

Figure 4:
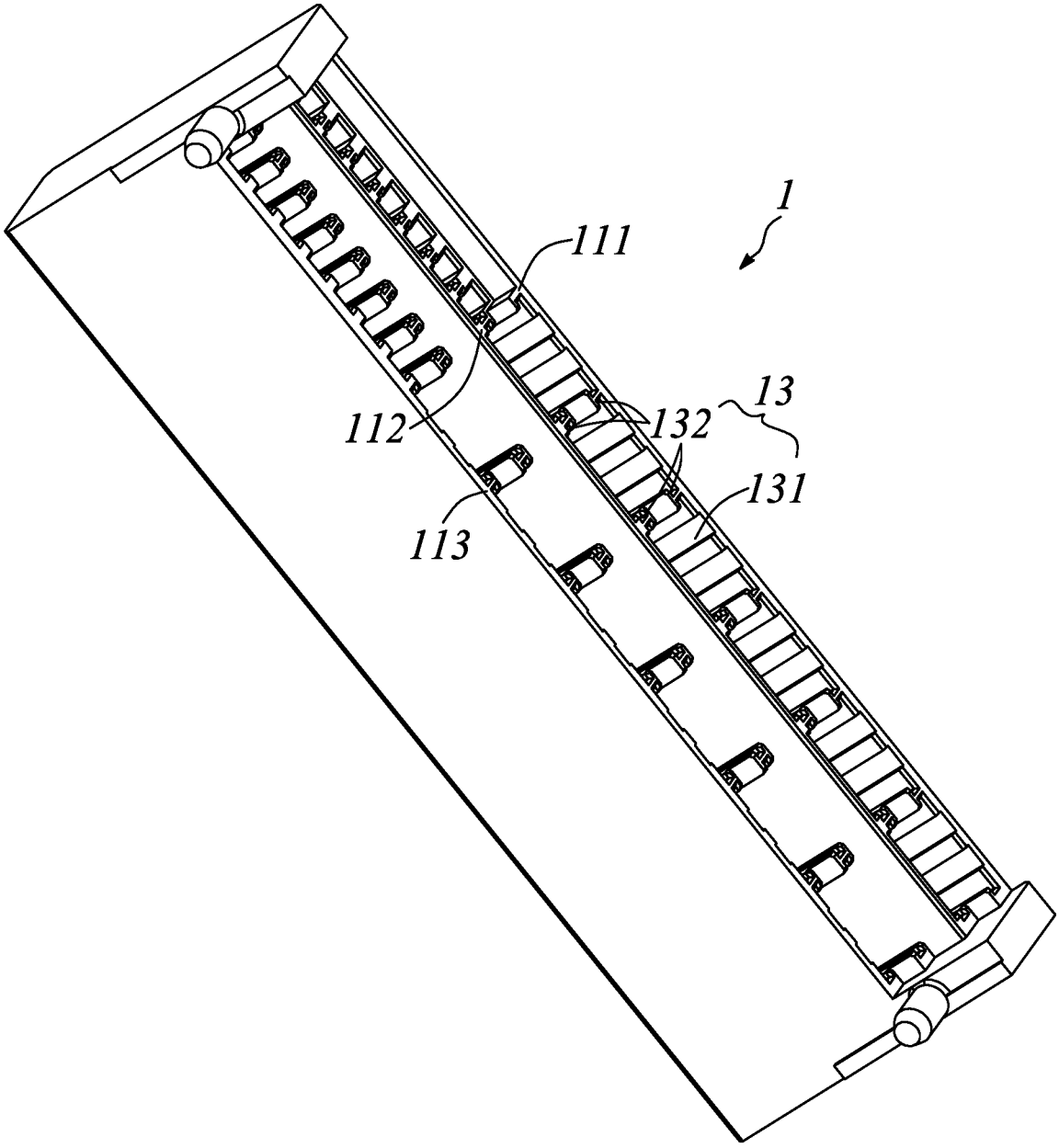
FIG. 4 is a perspective view of an insulative housing of the electrical connector shown in FIG. 2.
Figure 5:
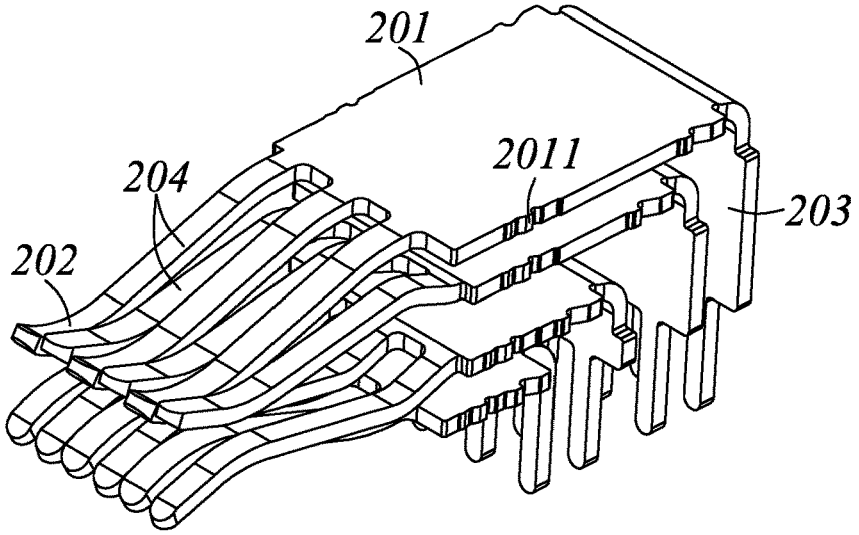
FIG. 5 is a perspective view of a group of power contact pairs of the electrical connector shown in FIG. 2.
Figure 6:
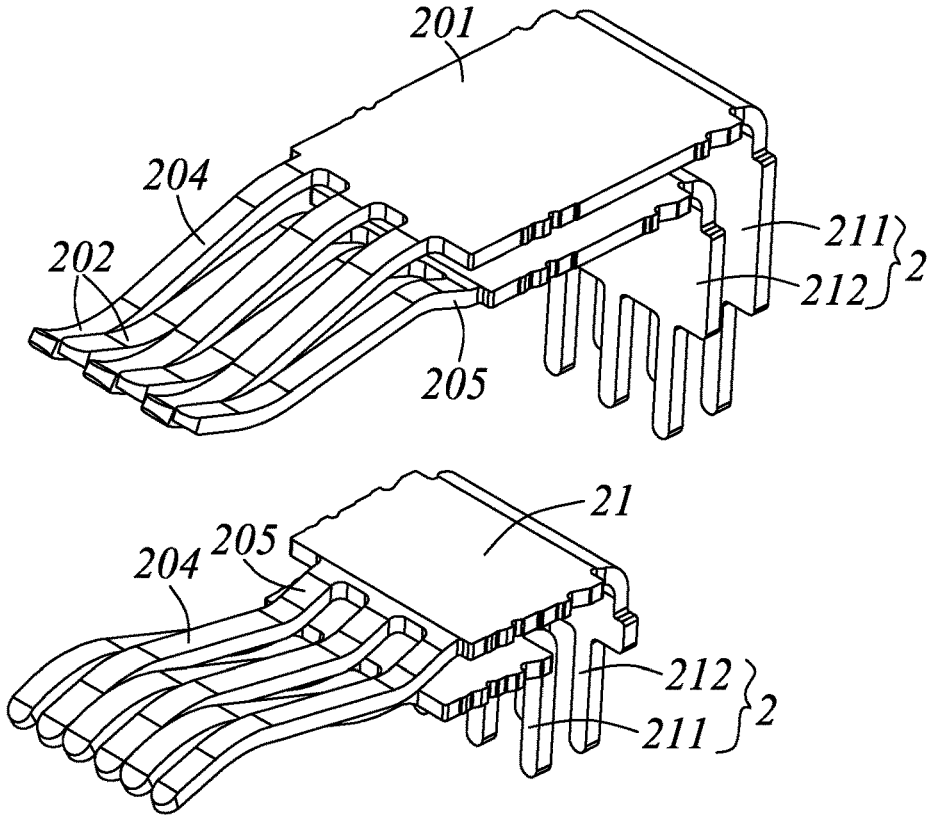
FIG. 6 is an exploded view of the group of power contact pairs shown in FIG. 5.
Figure 9:
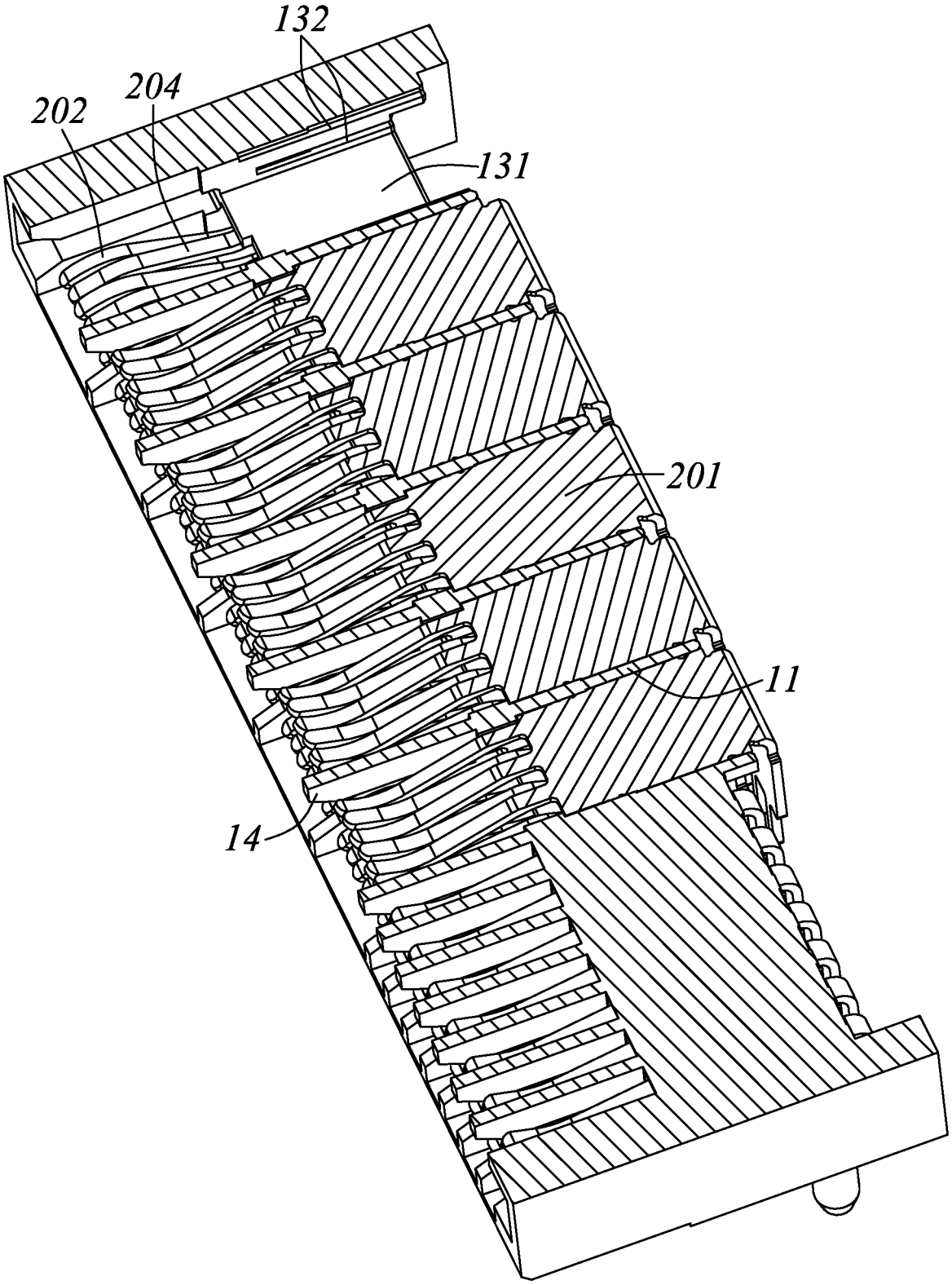
FIG. 9 is a cross-section view of the electrical connector of FIG. 1, and showing one contact removed away.
Figure 10:
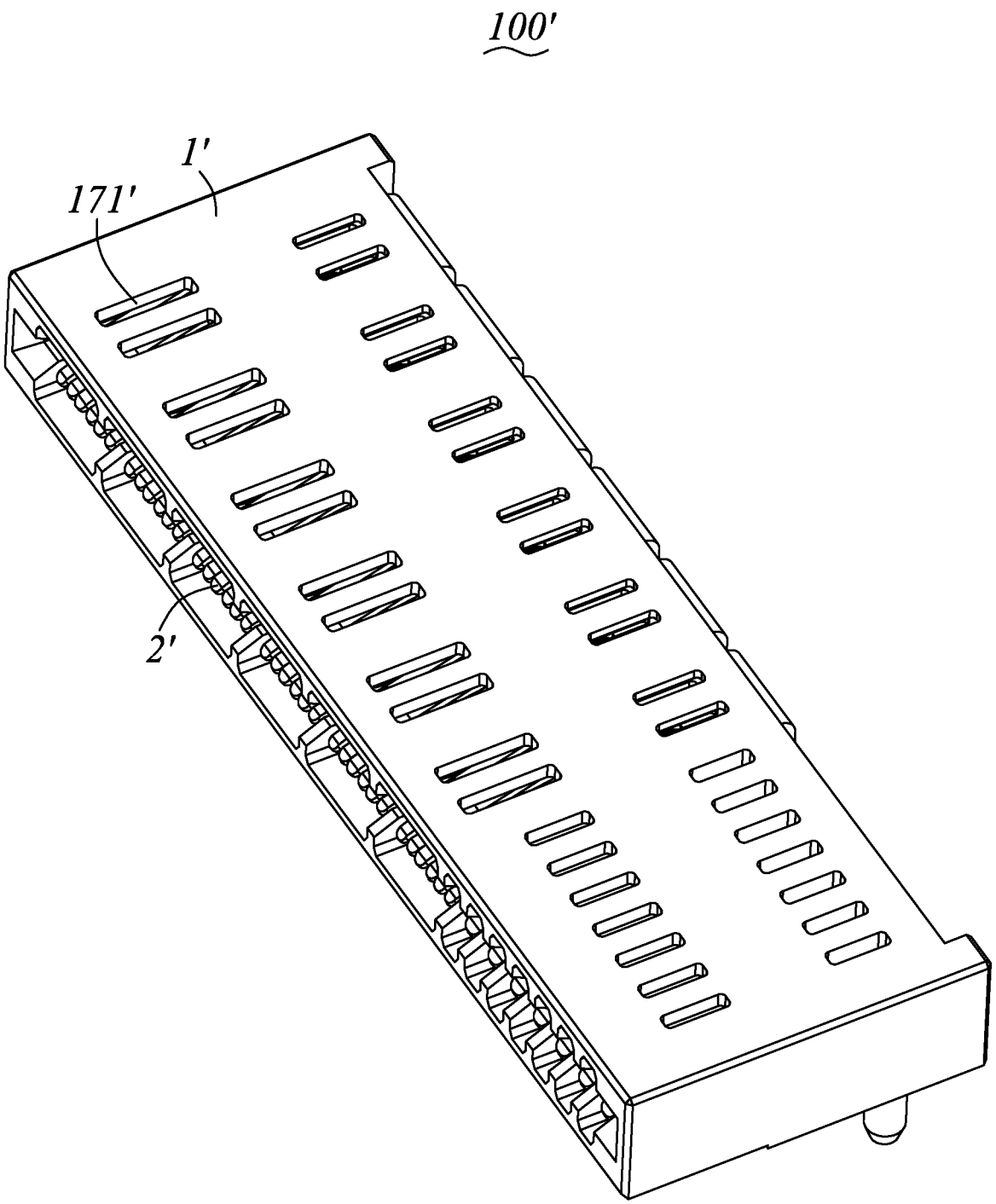
FIG. 10 is an assembled perspective view of an electrical connector according to a second embodiment of the present invention.
Figure 11:
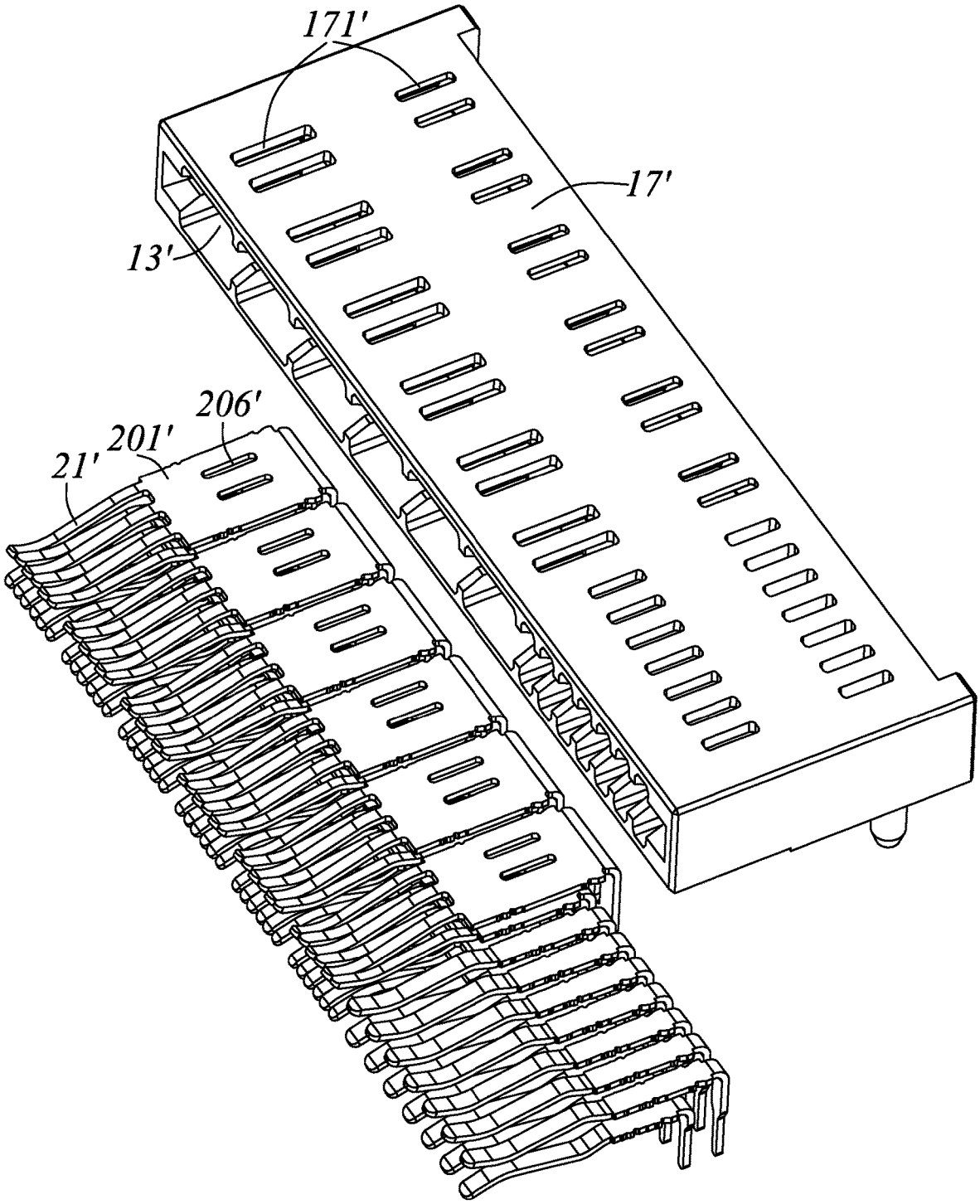
FIG. 11 is an exploded view of the electrical connector shown in FIG. 10.
Figure 12:
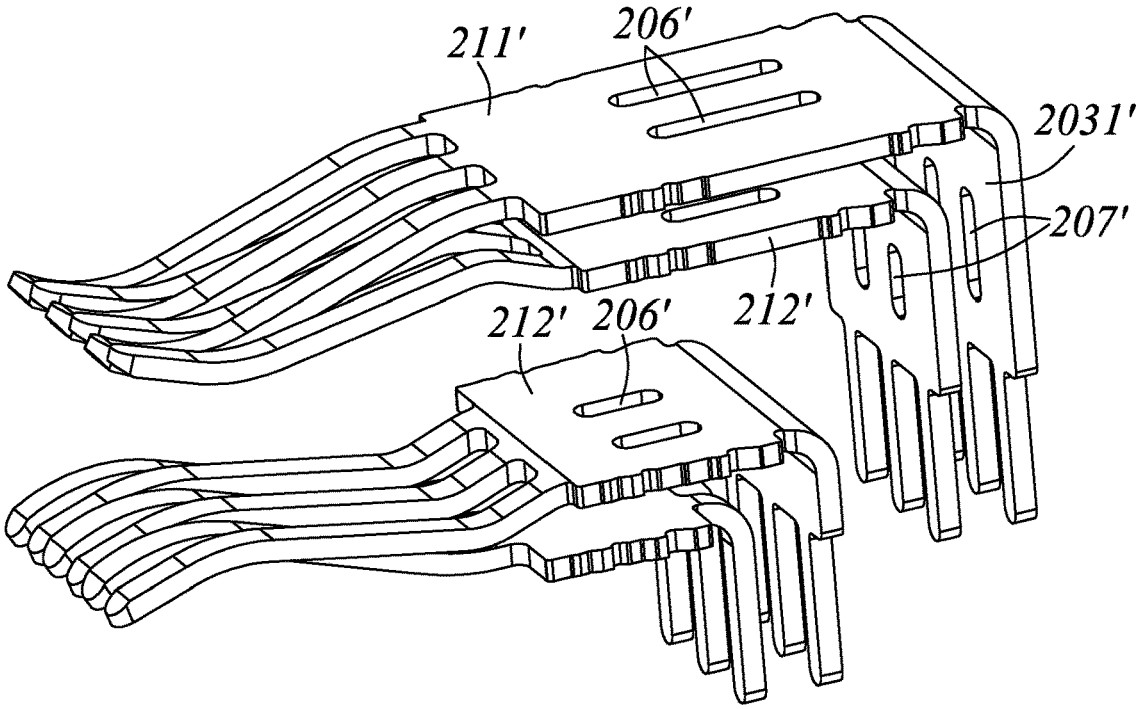
FIG. 12 is an exploded view of a group of power contact pairs of the electrical connector shown in FIG. 11.
Figure 13:
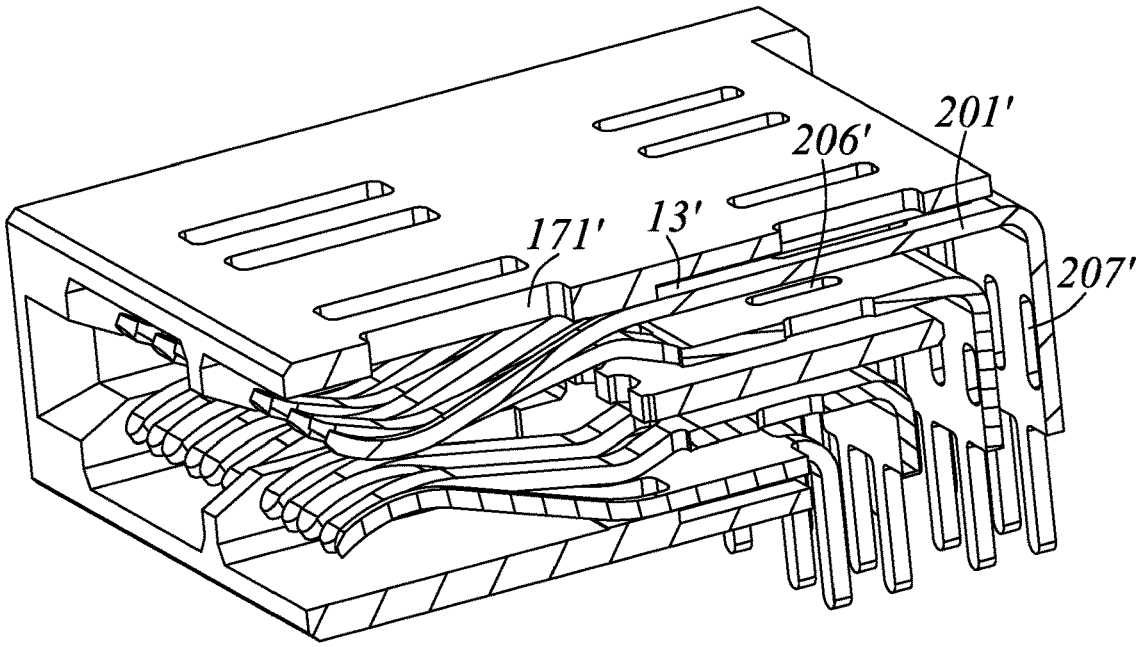
FIG. 13 is a cross-section view of the electrical connector shown in FIG. 10.
Figure 14:
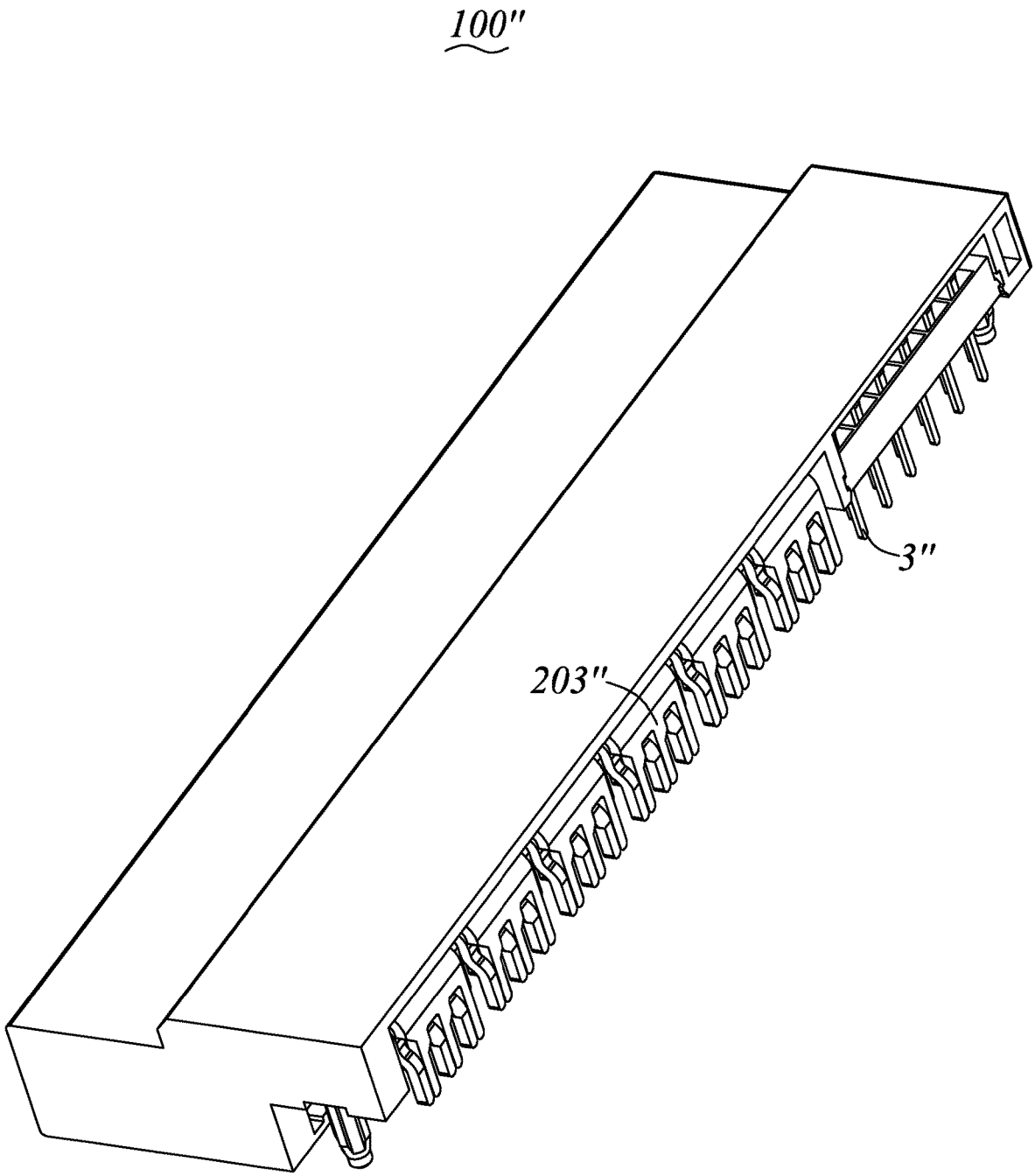
FIG. 14 is a perspective view of an electrical connector according to a third embodiment of the present invention.
Figure 15:
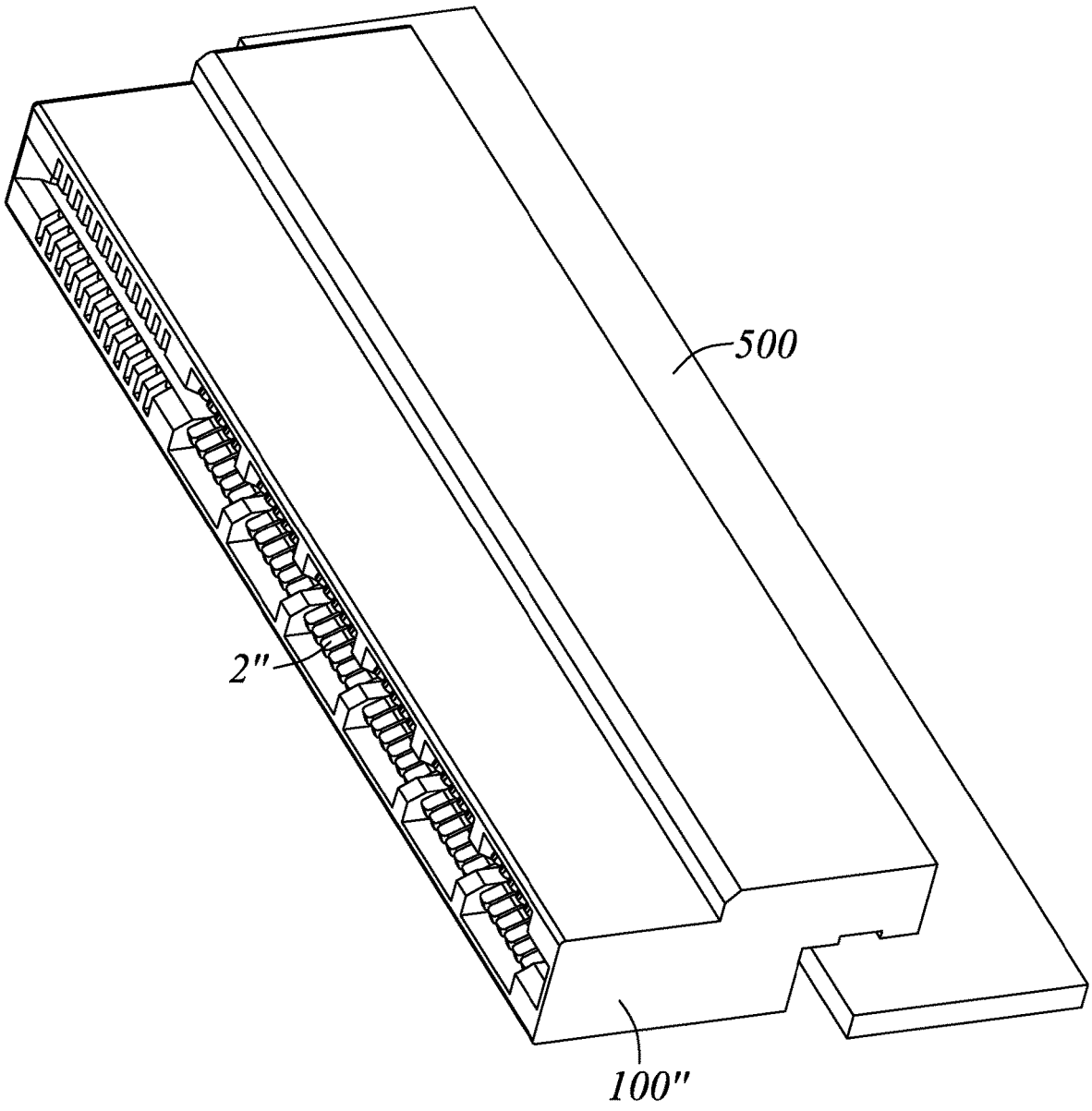
FIG. 15 is a perspective view of the electrical connector of FIG. 14 installed on a printed circuit board to form an electrical connector assembly.
Figure 16:
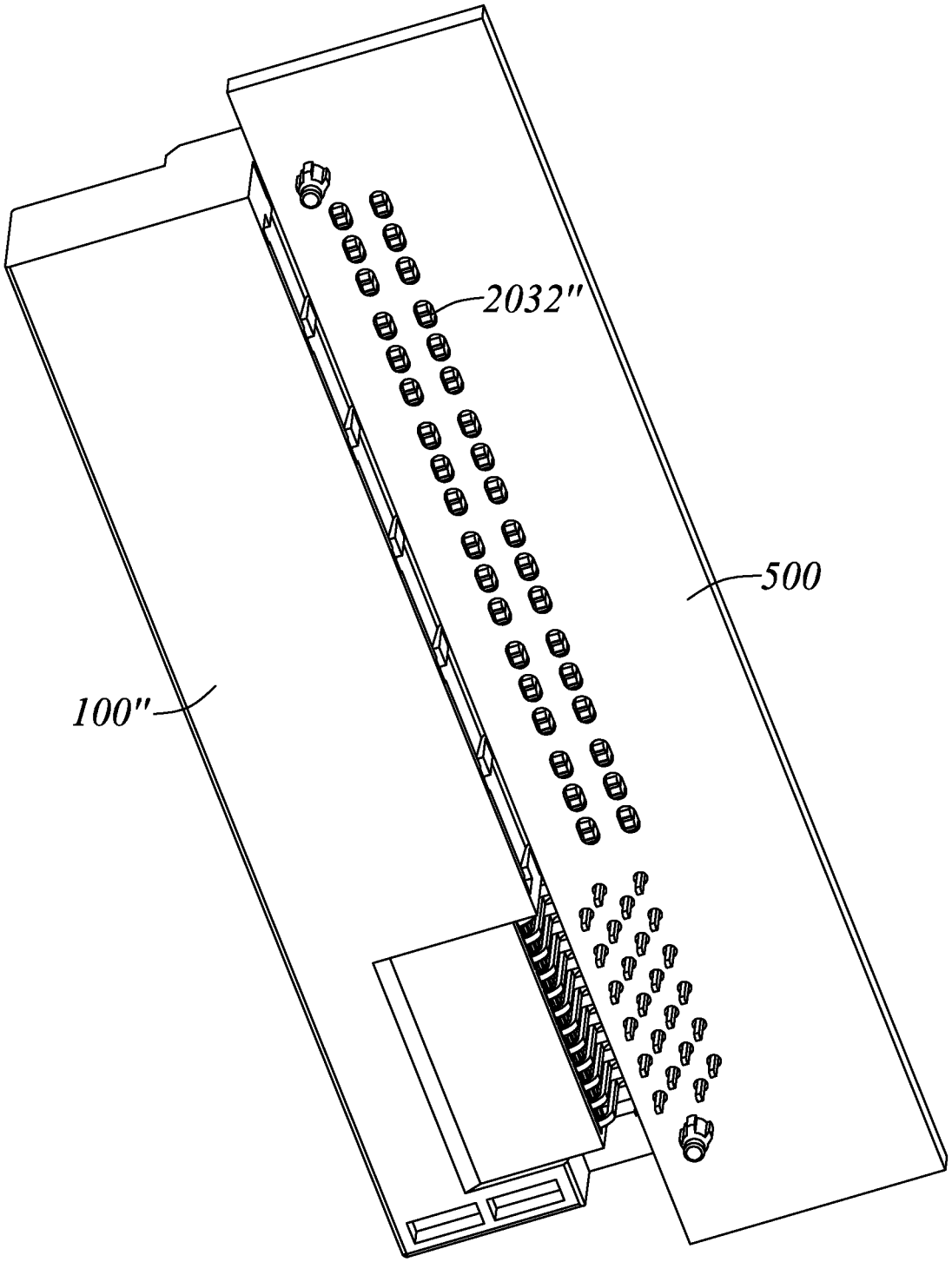
FIG. 16 is a view similar to FIG. 15, but viewed from a different angle.
Figure 17:
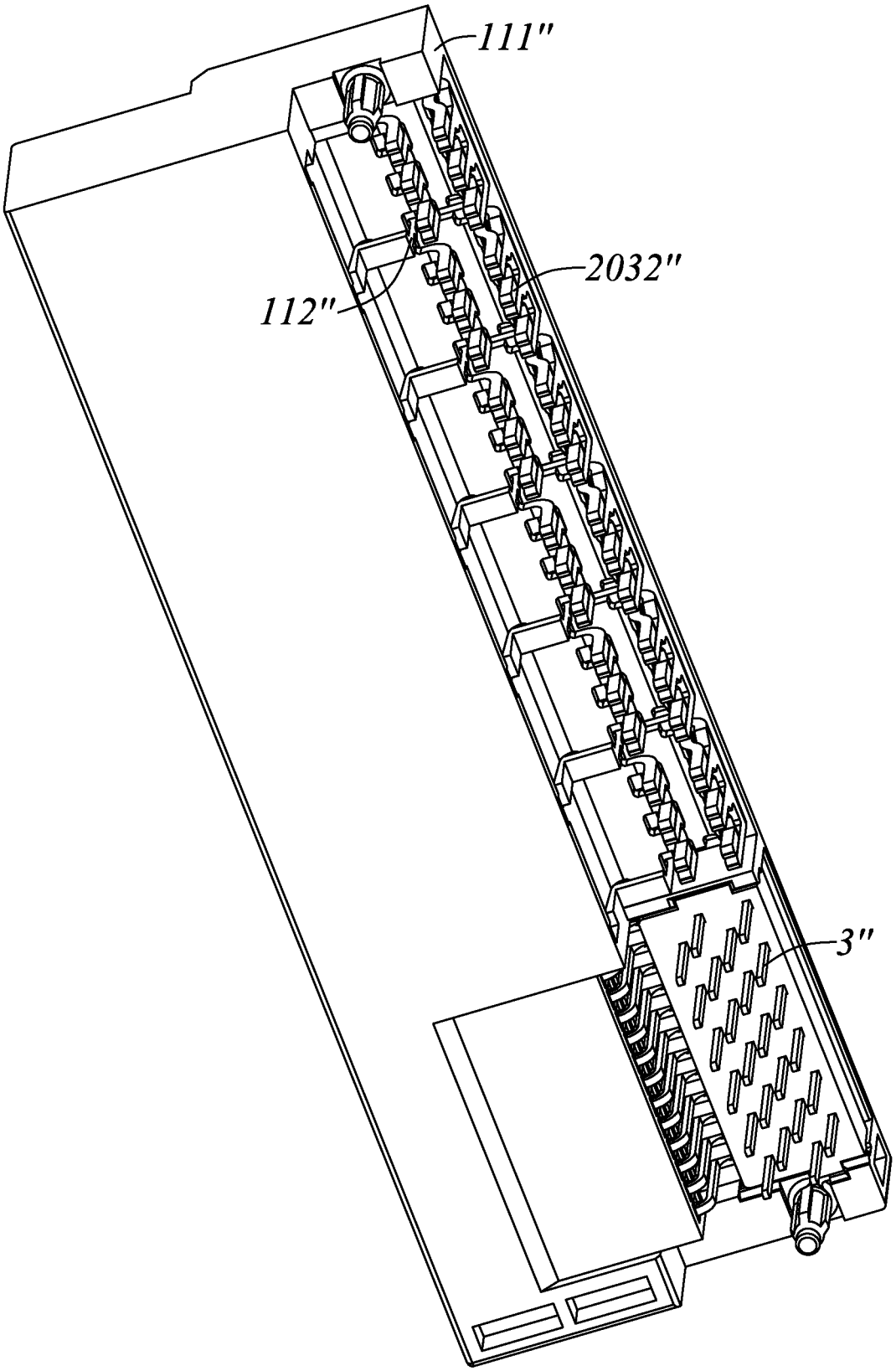
FIG. 17 is a view similar to FIG. 14, but viewed from another aspect.
Figure 18:
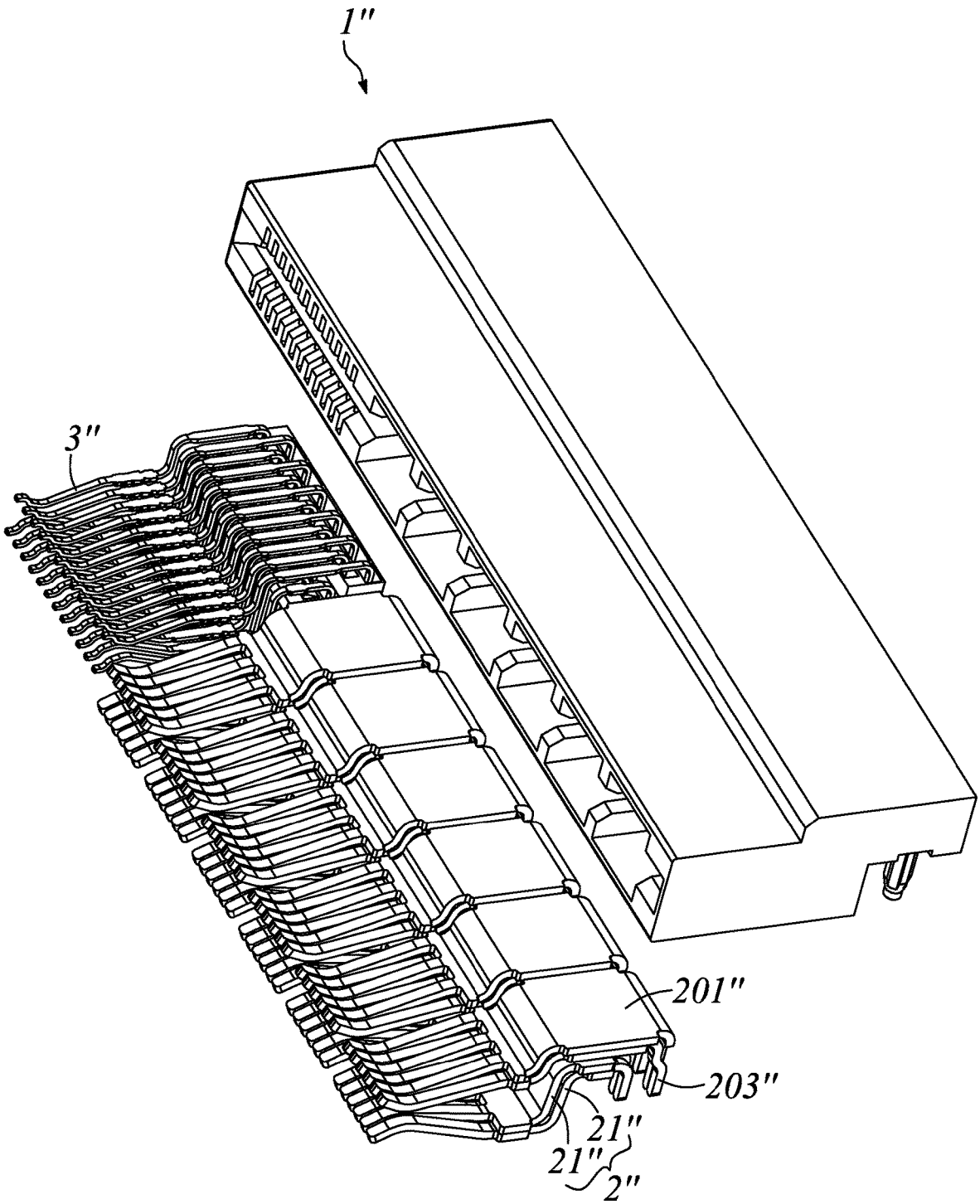
FIG. 18 is a partially exploded perspective view of the electrical connector of FIG. 14.

As illustrated in FIGS. 4 and 9, in this case, each first contact-receiving passageway 13 comprises a channel 131 penetrating through the main section 11 along the front-and-back direction and a plurality of fixing slots 132 communicated with the channel 131, the fixing slots 132 are arranged in pairs and symmetrically. And in this embodiment, each first contact-receiving passageway 13 has two pairs of fixing slots 132 spaced apart from each other along the height direction, two fixing slots 132 in each pair are disposed on both sides of the channel 131 along the transverse direction. In a same first contact-receiving passageway 13, each fixing slot 132 on an upper side has a larger extending length than the fixing slot 132 on a lower side in the front-and-back direction.

Referring to FIGS. 5-9, the power contact pairs 2 are received in the corresponding first contact-receiving passageways 13, and each power contact pair 2 includes two flaky power contacts 21. Each power contact 21 has a retaining portion 201 held in the relative first contact-receiving passageway 13, a number of contacting portions 202 extending forwards from the retaining portion 201 and a soldering portion 203 extending from a rear end of the retaining portion 201. The contacting portions 202 of two power contacts 21 in each power contact pair 2 are lined up in a row in the height direction, and arranged alternately and cyclically. Of course, the contacting portions 202 of two power contacts 21 in each power contact pairs 2 also can be misaligned along the height direction. As long as the electrical connector 100 is mating with the complementary member, the contacting portions 202 of two power contacts 21 in each power contact pairs 2 are located on a same horizontal plane.

The power contact pairs 2 are divided into two opposite rows in the height direction according to the contacting portions 202, that is, an upper row of power contact pairs 2 and a lower row of power contact pairs 2. The power contact pairs 2 are arranged in pairs along the height direction to form a group, and two power contact pairs 2 in each group are opposite to each other in the height direction and arranged at intervals. In the front-and-back direction, the soldering portions 203 of the upper row of power contact pairs 2 are located behind the second mounting face 112, and the soldering portions 203 of the lower row of power contact pairs 2 are located between the second mounting face 112 and the third mounting face 113.

In this embodiment, each power contact 21 has three contacting portions 202 extending forwards from the retaining portion 201, and the retaining portion 201 is a lamellar structure parallel to a horizontal plane. Each contacting portion 202 is curved, and has a contacting area 2020 protruding towards the interval wall 15.

The contacting portions 202 of the power contact pairs 2 in a same row are arranged in two staggered columns along the front-and-back direction. Meanwhile, the contacting areas 2020 of the power contact pairs 2 in a same row are located or approximately located on a same horizontal plane. In further, two neighboring contacting portions 202 in a same row are staggered in the front-and-back direction. Therefore, while the complementary member plugged in, two staggered columns of contacting portions 202 can be contacting with the complementary member successively, to achieve multi-level and multi-point contact and make the contact more fully, and the stability of electrical connection and current transfer of the electrical connector 100 can be enhanced. At the same time, the insertion and pulling force between the electrical connector 100 and the complementary member is evenly distributed, and the calorific value of the contacting surface is reduced.

The two power contacts 21 in each power contact pair 2 are called as an outer contact 211 and an inner contact 212 respectively. Wherein, compared with the outer contact 211, the retaining portion 201 and the contacting portions 202 of the inner contact 212 are closer to the interval wall 15 of the insulative housing 1. In each power contact pair 2 along the front-and-back direction, the contacting areas 2020 of the outer contact 211 are placed in front of the contacting areas 2020 of the inner contact 212. Thus, the contacting areas 2020 of the outer contacts 211 contact the complementary member first, and then the contacting areas 2020 of the inner contacts 211 contact the complementary member, in this way, the insertion and pulling force can be reduced to make the insertion feel better, and a deformation and a failure of an elastic contacting arm of each power contact 21 after long-term insertion and extraction can be avoided, so as to ensure a long-term electrical connection.

The retaining portions 201 of two power contacts 21 in each power contact pair 2 are spaced apart from each other in the height direction, and inserted into a same first contact-receiving passageway 13 from a rear side of the main section 11. Each retaining portion 201 defines a plurality of interferential portions 2011 on lateral sides in the transverse direction, and the interferential portions 2011 are protruding outwards to engage with the corresponding fixing slots 132 by an interference fit.

Figure 7:
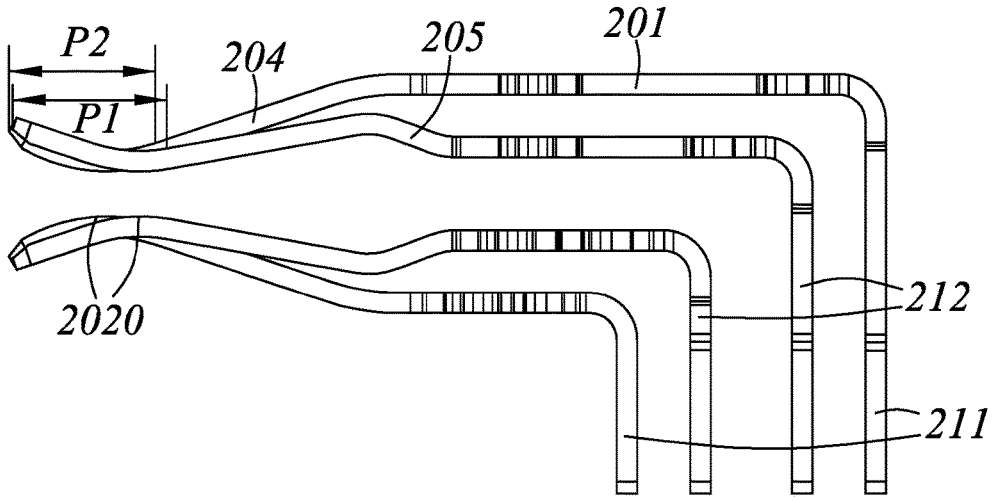
FIG. 7 is a side view of FIG. 5.
Figure 8:
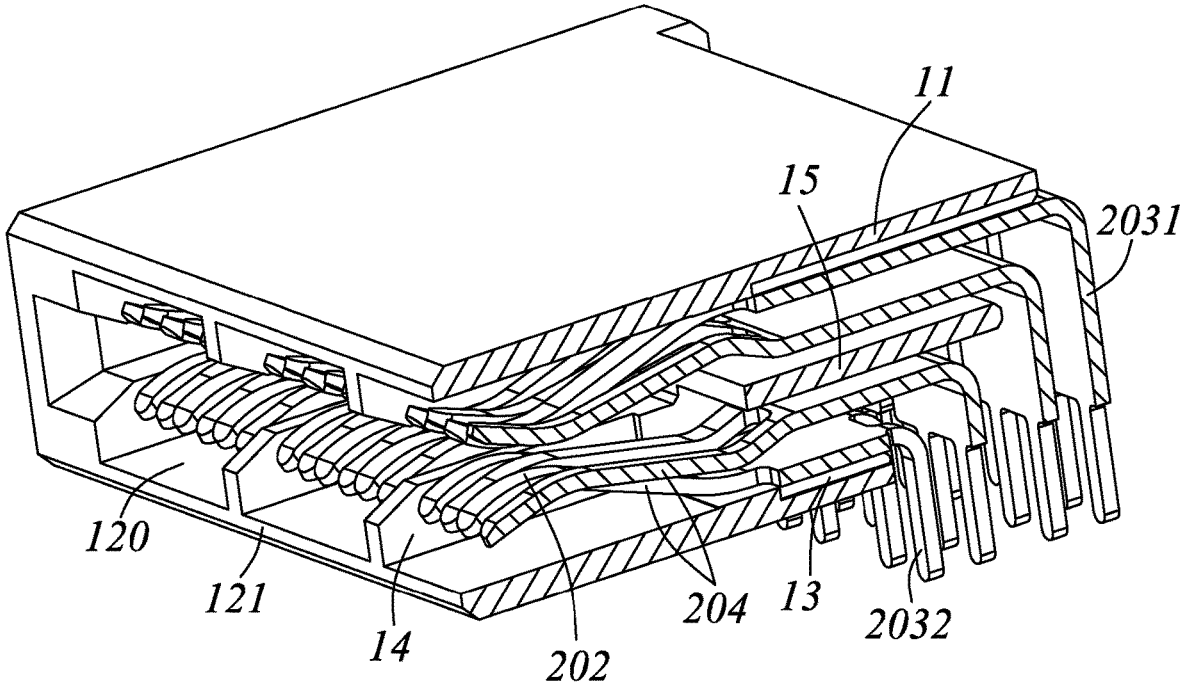
FIG. 8 is a sectional view of FIG. 1.

As illustrated in FIG. 7, in an up-to-down direction, the lengths of the retaining portions 201 of four power contacts 21 in each group of power contact pairs 2 in the front-and-back direction are decreased successively, that is to say, among the two power contacts 21 of each power contact pair 2 in the upper row, the retaining portion 201 of the outer contact 211 is longer than that of the inner contact 212 along the front-and-back direction. Among two power contacts 21 of each power contact pair 2 in the lower row, the retaining portion 201 of the inner contact 212 has a larger length than that of the outer contact 211 along the front-and-back direction. Additionally, the retaining portion 201 of the inner contact 212 of each power contact pair 2 in the upper row has a larger length than that of the inner contact 212 of each power contact pair 2 in the lower row.

Also shown in FIG. 7, a side view of a group of power contact pairs on a vertical plane is illustrated, one of two neighboring contacting portions 202 in a same row has a projection P1 on a vertical plane at least partially overlapped with a projection P2 on the vertical plane of the other of two neighboring contacting portions 202.

Each soldering portion 203 comprises a plate portion 2031 bending downwards from the rear end of the retaining portion 201 and a plurality of welding legs 2032 extending downwards from a bottom end of the plate portion 2031. In this embodiment, the plate portion 2031 is parallel to a vertical plane, and the welding legs 2032 are extending and coplanar with the plate portion 2031 to insert an external circuit board (not shown).

Each power contact 21 has a plurality of elastic contacting arms 204 extending forwards from a front end of the retaining portion 201, each contacting portion 202 is connected with and in front of the relative contacting arm 204 for mating with the complementary member. The contacting arms 204 are passing forwards through the first contact-receiving passageways 13 and received in the mating section 12.

The angle between each contacting arm 204 of the outer contact 211 and the horizontal plane is greater than the angle between each contacting arm 204 of the relative inner contact 212 and the horizontal plane, that is to say, each contacting arm 204 of the outer contact 211 has a greater slope than that of the inner contact 212. In this embodiment, each inner contact 212 further has a connecting arm 205 connecting the contacting arm 204 with the retaining portion 201, and the connecting arm 205 and the contacting arm 204 are bent and extending in opposite directions so that the angled opening between them is facing inwards (i.e., towards the interval wall 15).

Specially, take the upper row of power contact pairs 2 as an example, the connecting arm 205 is extending forwards and bending upwards from a front end of the retaining portion 201, the contacting arm 204 is extending forwards and bending downwards from a front end of the connecting arm 205, so the angled opening between the contact arm 204 and the connecting arm 205 is downward. In further, two retaining portions 201 and the segments in front of the retaining portions 201 (including the contacting arms 204, the connecting arms 205 and the contacting portions 202) of each power contact pair 2 in the upper row are arranged as mirror images of two retaining portions 201 and the segments in front of the retaining portions 201 of each power contact pair 2 in the lower row.

Figure 2:
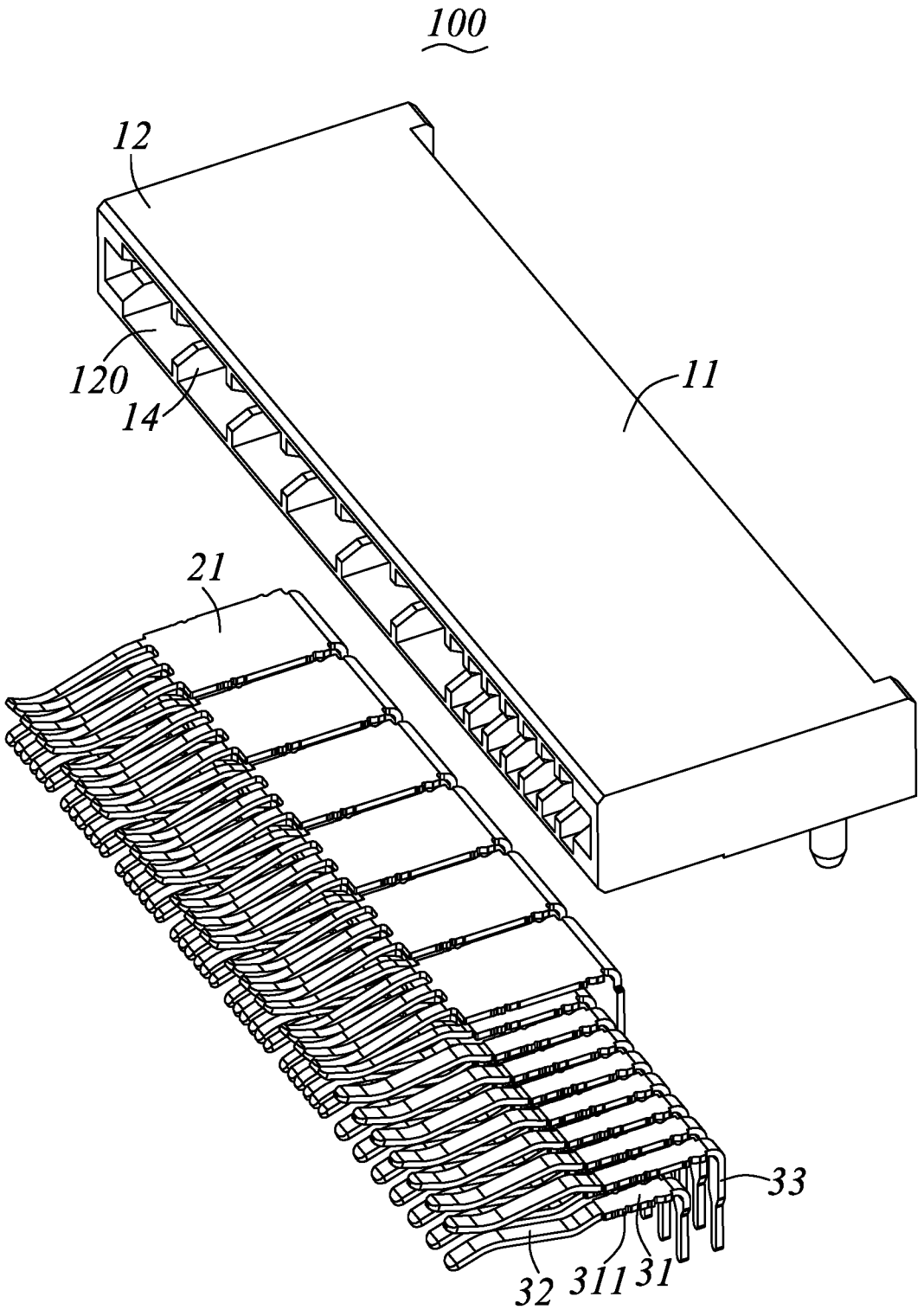
FIG. 2 is an exploded view of the electrical connector shown in FIG. 1.
Figure 3:
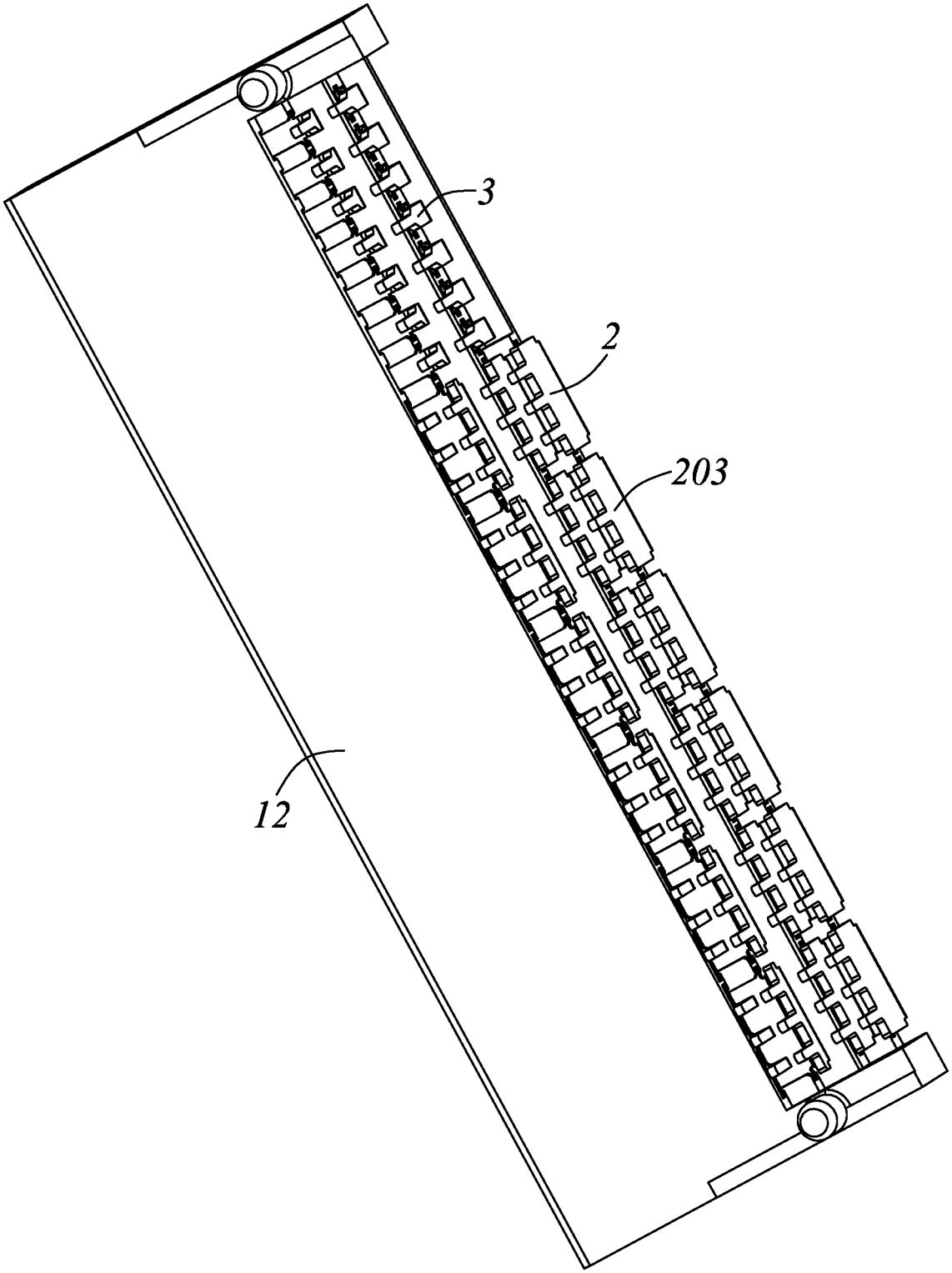
FIG. 3 is a view similar to FIG. 1, but viewed from a different angle.

Referring to FIGS. 1 to 3 and conjunction with FIG. 9, in this case, the electrical connector 100 further has a plurality of signal contacts 3 on one lateral side of the power contact pairs 2 along the transverse direction, the insulative housing 1 defines a plurality of second contact-receiving passageways 16 on one side of the first contact-receiving passageways 13.

Each signal contact 3 comprises a positioning portion 31, a mating arm 32 extending from one end of the positioning portion 31 and a soldering leg 33 extending from the other end of the positioning portion 31. The positioning portion 31 is inserted into the second contact-receiving passageways 16 from a rear side of the main section 11 and fixed in the second contact-receiving passageways 16, and the mating arm 32 in front of the positioning portion 31 is protruding into the mating section 12 to make an electrical connection with the complementary member.

In the present embodiment, the positioning portion 31 defines at least a pair of barbs 311 on both sides thereof, and the barbs 311 are engaging with the main section 11 interferentially, so the signal contacts 3 can be fixed in the insulative housing 1 to prevent the signal contacts 3 from shaking when mating with the complementary member and improve the stability of mating.

In this case, the contacting portions 202 of two power contacts 21 in each power contact pair 2 are lined up in a row in the height direction, and arranged alternately and cyclically in the transverse direction, thereby effectively increasing the current channel and reducing the heating of the power contact pairs 2, and then improving the transmission reliability of electrical connector 100.

FIGS. 10 to 13 illustrate an electrical connector in a second embodiment of the present invention, and the electrical connector includes an insulative housing 1' and a plurality of power contact pairs 2' retained in the insulative housing 1'. Herein, the insulative housing 1' and the power contact pairs 2' are similar or same as that of the first embodiment, so the description for them is omitted here for the second embodiment. The difference between the two embodiments is explained as follows.

The insulative housing 1' is provided with a number of first heat radiating channels 171' in a top wall 17' thereof, and the first heat radiating channels 171' are penetrating through the top wall 17' in a height direction thereof, and communicated with the relative first contact-receiving passageways 13' on an inner side thereof. In further, in this embodiment, two rows of first heat radiating channels 171' are disposed in the top wall 17' and aligning with each other along a front-and-back direction. The first heat radiating channels 171' in each row are arranged side by side in a transverse direction, in the front-and-back direction, each first heat radiating channel 171' in the front row has a larger length than the first heat radiating channel 171' in the rear row.

At least an upper power contact 21' in each power contact pair 2' has at least one second heat radiating channel 206', the second heat radiating channel 206' is defined in a retaining portion 201' and penetrating through the retaining portion 201' along the height direction. In this embodiment, the retaining portion 201' of each power contact 21' in each upper power contact pair 2' is provided with the second heat radiating channel 206'. Among two power contact 21' in each lower power contact pair 2', only the upper power contact 21' (also known as an inner contact 212' in each lower power contact pair 2') is provided with the second heat radiating channel 206'.

As the retaining portions 201' fixed in the corresponding first contact-receiving passageways 13', the heat generated after the power contact 21' energized can be dissipated through the second heat radiating channel 206', the first contact-receiving passageways 13' and the first heat radiating channel 171', to avoid heat accumulation inside the insulative housing 1'.

Simultaneously, a plate portion 2031' of each power contact 21' of each power contact pair 2' in the upper row is provided with at least one third heat radiating channel 207'. In the height direction, the third heat radiating channel 207' in an outer contact 211' has a greater length than the third heat radiating channel 207' in the relative inner contact 212'. Additionally, the projections of the third heat radiating channels 207' of the two power contacts 21' of each power contact pair 2' in the upper row on a vertical plane are at least partially overlapped. The projections of the third heat radiating channels 207' on the vertical plane fall into the projection of the first contact-receiving passageways 13' in a lower row on the same vertical plane. Thus, the third heat radiating channels 207' are aligning with the first contact-receiving passageways 13' in the lower row along the front-and-back direction. In this embodiment, the projections of the third heat radiating channels 207' in the inner contact 212' on the vertical plane fall into the projections of the relative third heat radiating channels 207' in the outer contact 211' on the vertical plane. Therefore, the outer dissipating channel can be larger, to facilitate dissipating heat from power contacts rapidly.

FIGS. 14-23 illustrate an electrical connector 100" according to a third embodiment of the present invention, and the electrical connector 100" is mounted on a printed circuit board 500 to form an electrical connector assembly. An insulative housing 1", power contact pairs 2" and signal contacts 3" of the electrical connector 100" in the third embodiment of the present invention are similar or same as that of the first embodiment, so the description for them is omitted here for the third embodiment. The difference is as follows:

In this embodiment, in a front-and-back direction, soldering portions 203" of two rows of power contact pairs 2" are located between a first mounting face 111" and a second mounting face 112". Retaining portions 201" of two power contacts 21" in each power contact pair 2" are stacked with each other along a height direction.

Each connecting arm 205" comprises a first connecting arm 2051" connecting a back end of a contacting arm 204" and a second connecting arm 2052" extending backwards and bending upwards from a rear end of the first connecting arm 2051" slantwise. A rear end of the second connecting arm 2052" is connecting with the retaining portion 201".

Welding legs 2032" of two power contacts 21" in each power contact pair 2" are arranged with a one-to-one correspondence, and every two corresponding welding legs 2032" are juxtaposed and constituting a welding leg group.

Figure 19:
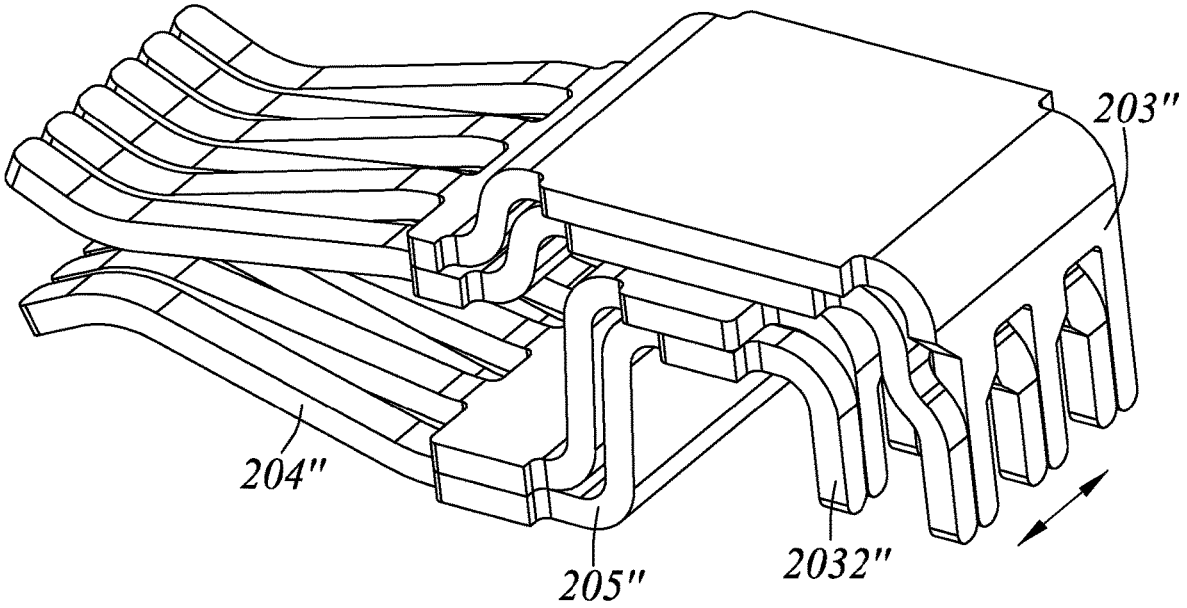
FIG. 19 is a perspective view of a group of power contact pairs of the electrical connector shown in FIG. 18.

Specially, as shown in FIG. 19, in this embodiment, two welding legs 2032" in each welding leg group are arranged abreast and stagger along a transverse direction. In the arrangement direction (as a direction indicated by an arrow shown in FIG. 19) of the two welding legs 2032" in each welding leg group, an extending dimension L1 of each welding leg 2032" is in the range of 0.4 mm to 0.64 mm.

The printed circuit board 500 defines a plurality of through holes 51, the welding legs 2032" in a same welding leg group are inserted into a same through hole 51.

A gap G is formed between two welding legs 2032" in each welding leg group, so that solder welding to the printed circuit board 500 can be better wrapping around the welding legs 2032", to establish a stable electrical connection with the printed circuit board 500. Furthermore, as a preferred embodiment of the present invention, a width of the gap G between two welding legs 2032" in each welding leg group is in the range of 0.1 mm to 0.5 mm.

Moreover, in the arrangement direction of the two welding legs 2032" in each welding leg group, the extending dimension L1 of each welding leg 2032" is less than four times of the width of the gap G.

Figure 24:
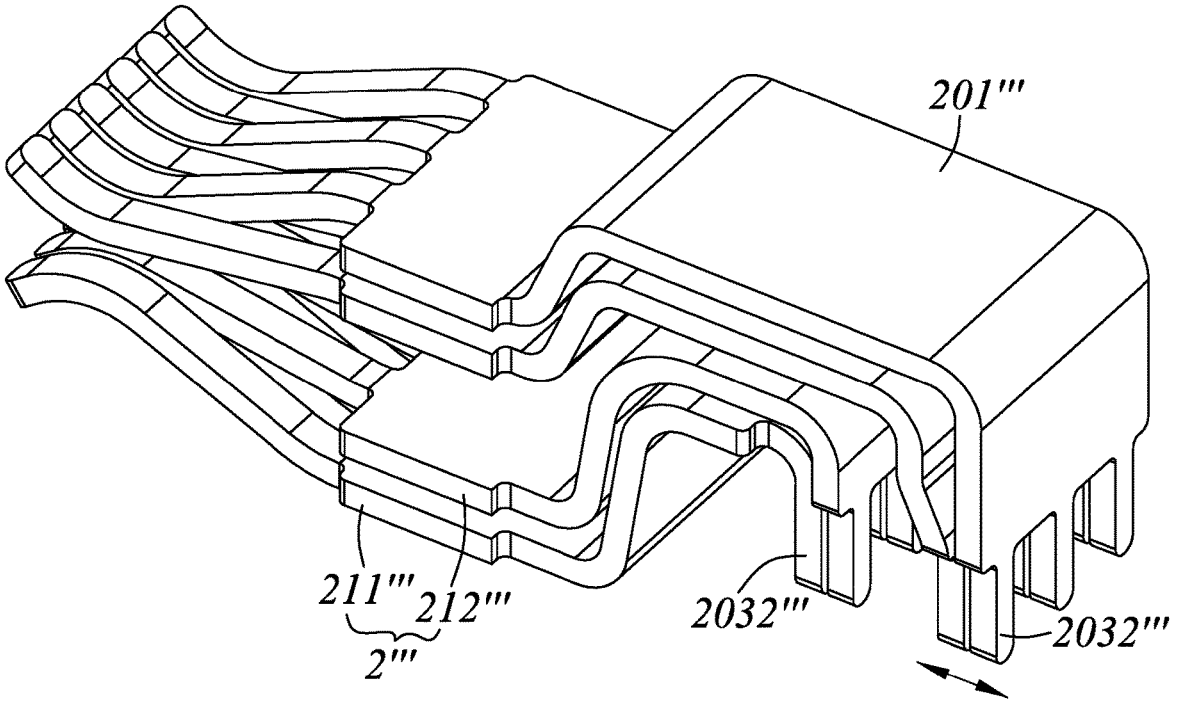
FIG. 24 is a perspective view of one group of power contact pairs of an electrical connector according to a fourth embodiment of the present invention.
Figure 25:
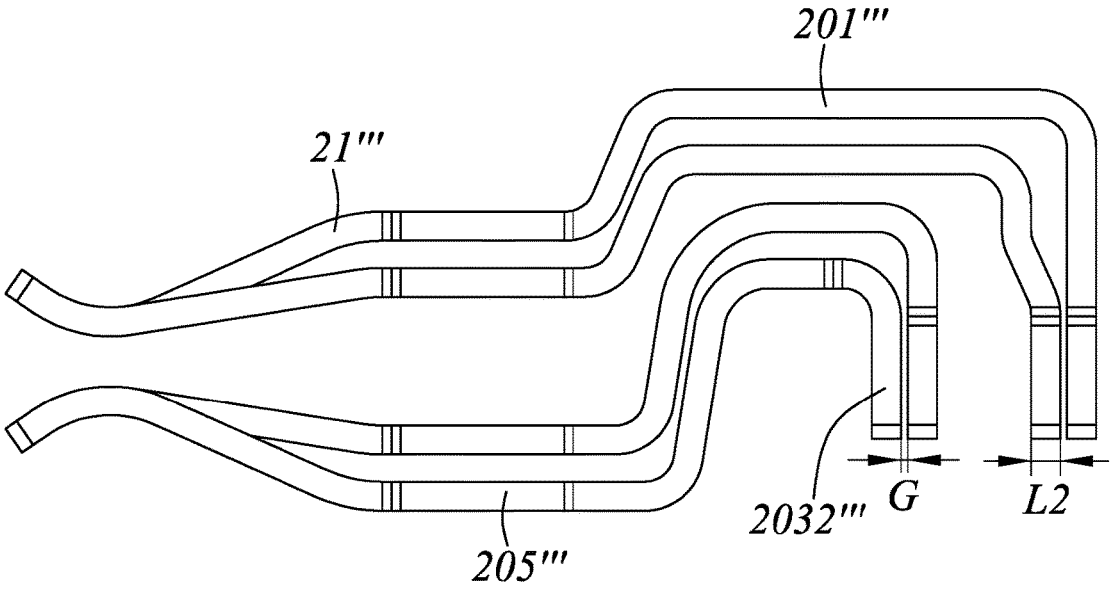
FIG. 25 is a side view of the group of power contact pairs shown in FIG. 24.
Figure 26:
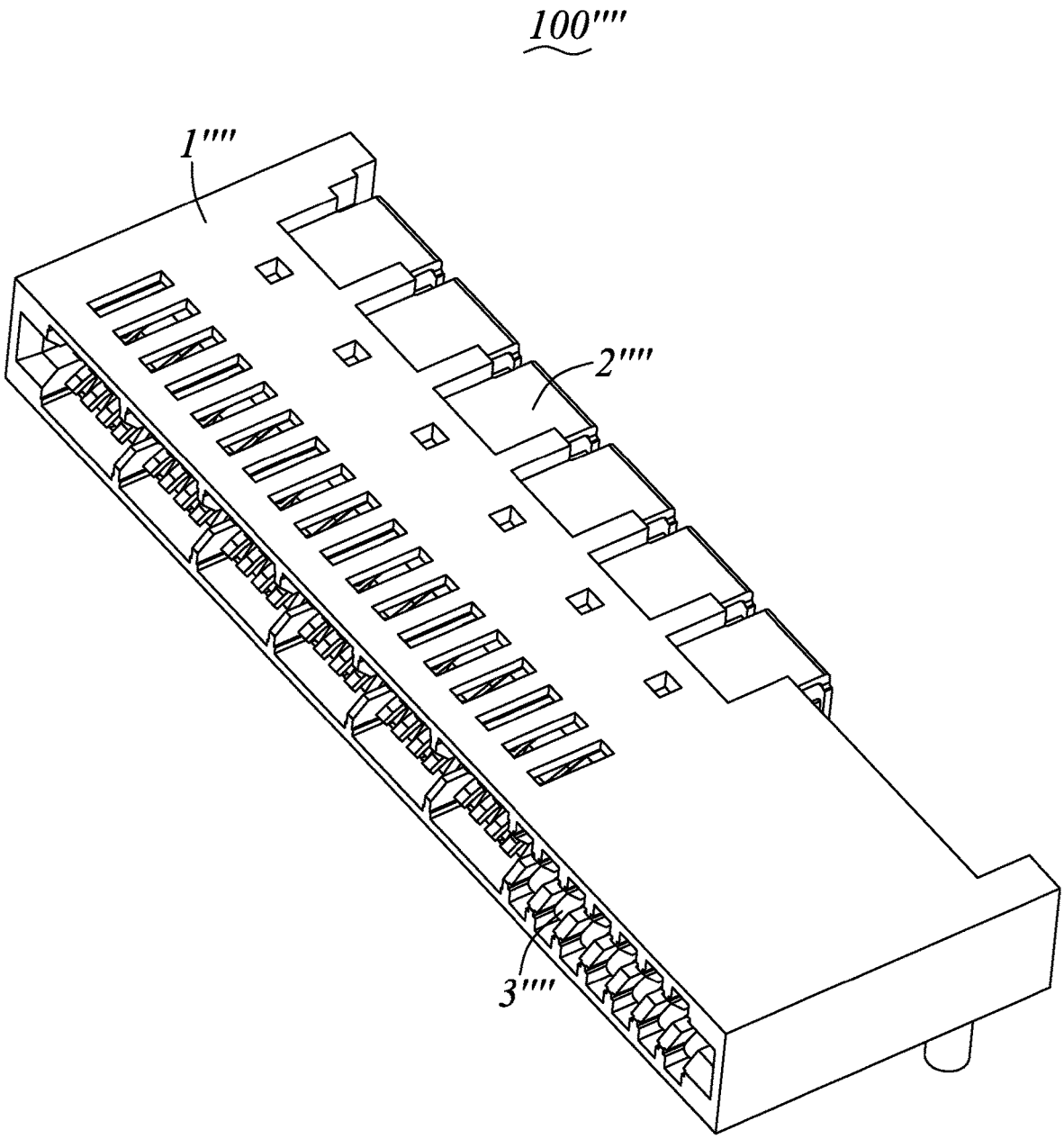
FIG. 26 is a perspective view of an electrical connector according to a fifth embodiment of the present invention.
Figure 27:
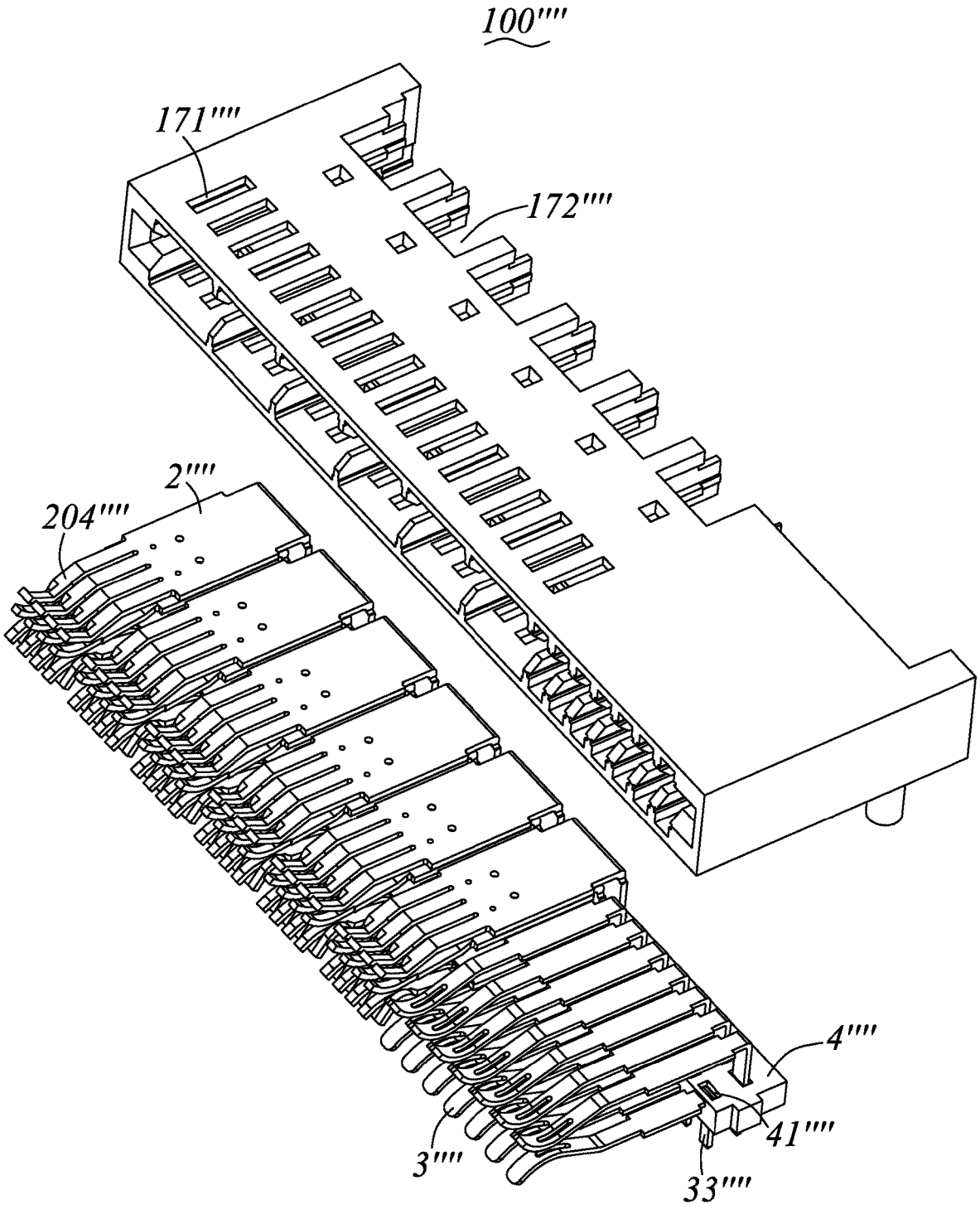
FIG. 27 is an exploded view of the electrical connector shown in FIG. 26.
Figure 28:
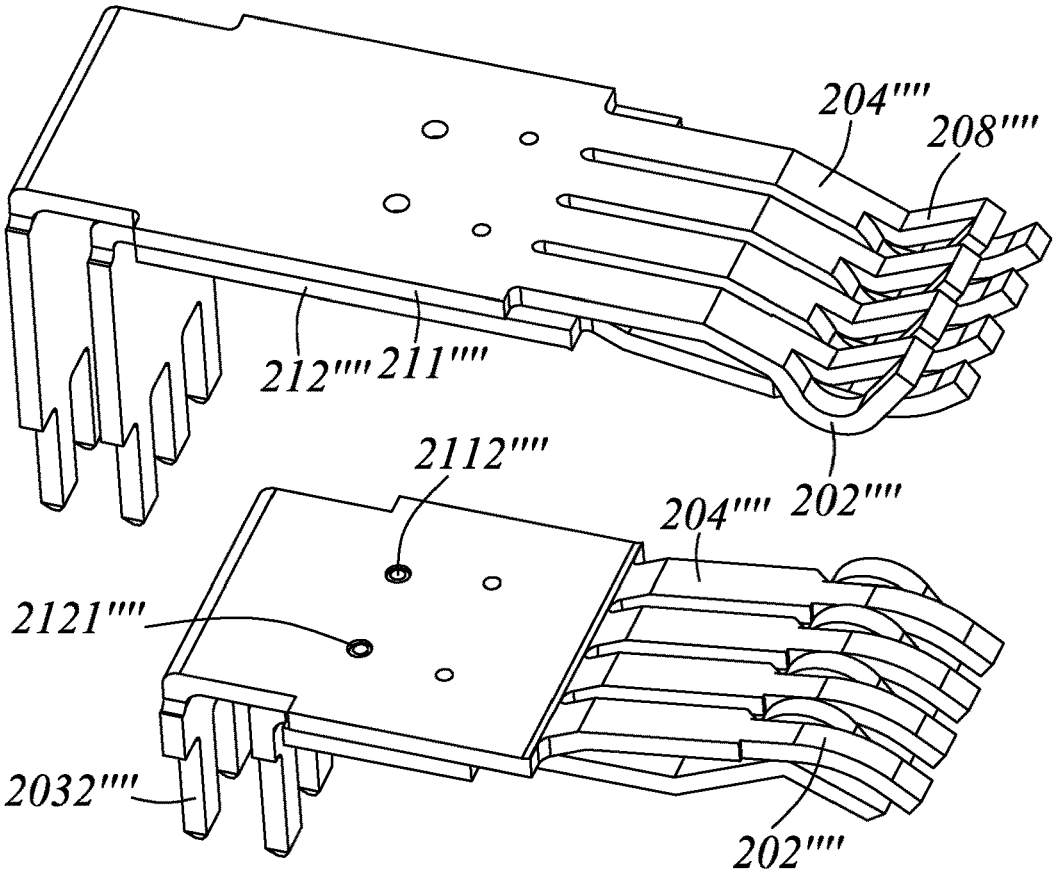
FIG. 28 is a partially exploded view of a group of power contact pairs shown in FIG. 27.

FIGS. 24-25 illustrate a group of power contact pairs 2''' of an electrical connector according to the fourth embodiment of the present invention, and the group of power contact pairs 2''' is similar as the third embodiment, so the description for it is omitted here for the third embodiment. The difference is as follows: two welding legs 2032''' in each welding leg group are arranged abreast along a front-and-back direction. In the arrangement direction (as a direction indicated by an arrow shown in FIG. 24) of the two welding legs 2032''' in each welding leg group, an extending dimension L2 of each welding leg 2032''' is in the range of 0.4 mm to 0.64 mm.

In further, in this embodiment, among each power contact pair 2''', the welding legs 2032''' of an inner contact 212''' are aligning with the relative welding legs 2032''' of an outer contact 211''' along the front-and-back direction, and the welding legs 2032''' of the inner contact 212''' of each power contact pair 2''' in an upper row are located in front of the welding legs 2032''' of the relative outer contact 211''', the welding legs 2032''' of the inner contact 212''' of each power contact pair 2''' in a lower row are located behind the welding legs 2032''' of the relative outer contact 211'''. Additionally, both of retaining portions 201''' and connecting arms 205''' of the two power contacts 21''' in each power contact pair 2''' are spaced apart from each other along a height direction with a certain distance, thereby increasing air convection for a better heat dissipation.

Figure 20:
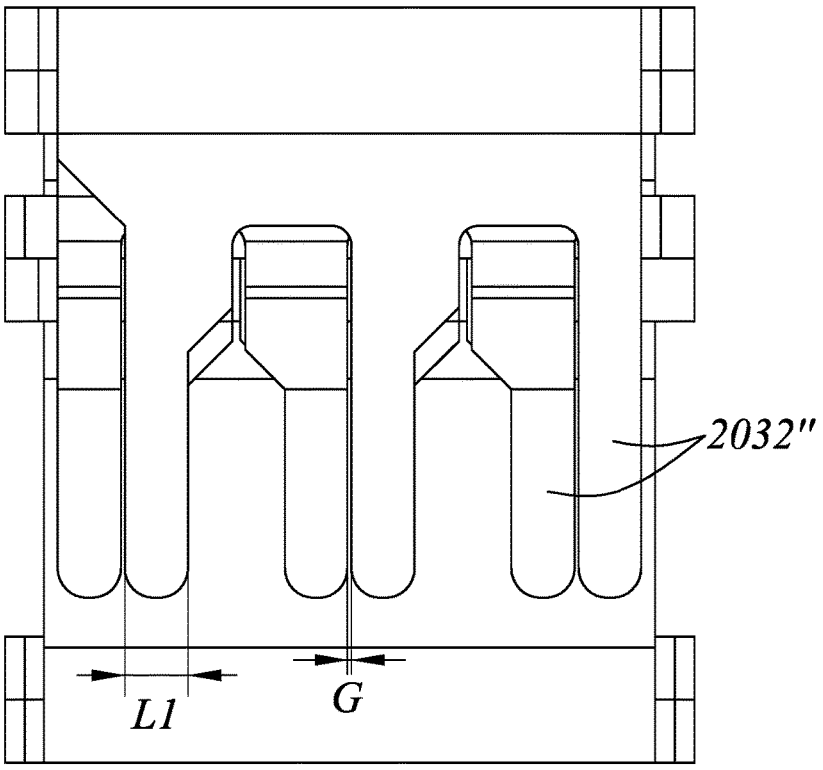
FIG. 20 is a back view of the group of power contact pairs shown in FIG. 19.
Figure 21:
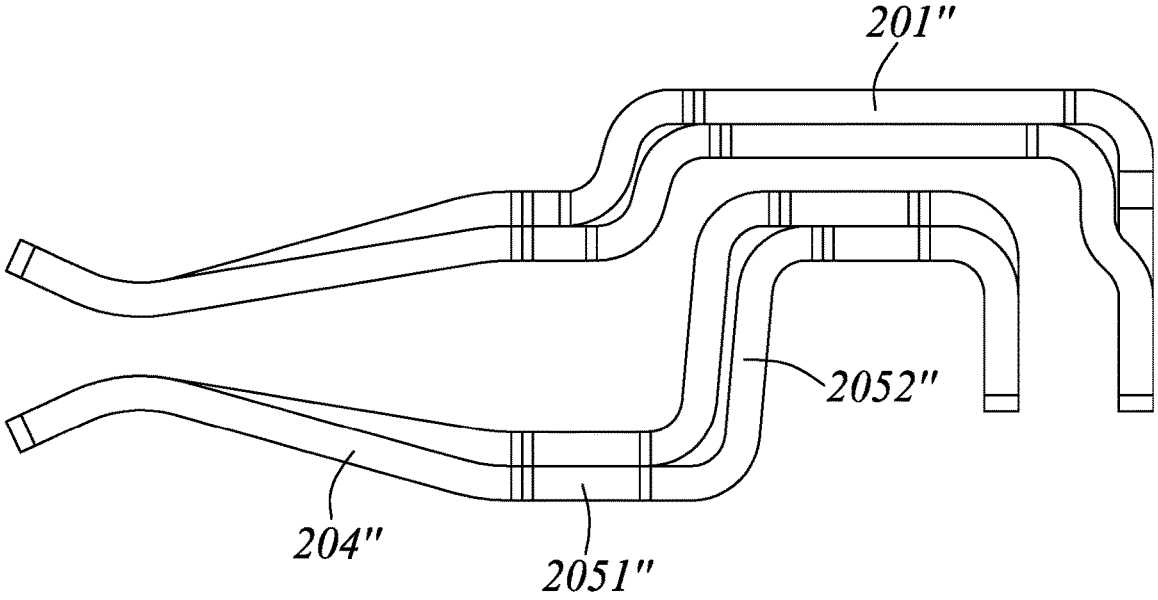
FIG. 21 is a side view of the group of power contact pairs shown in FIG. 19.
Figure 22:
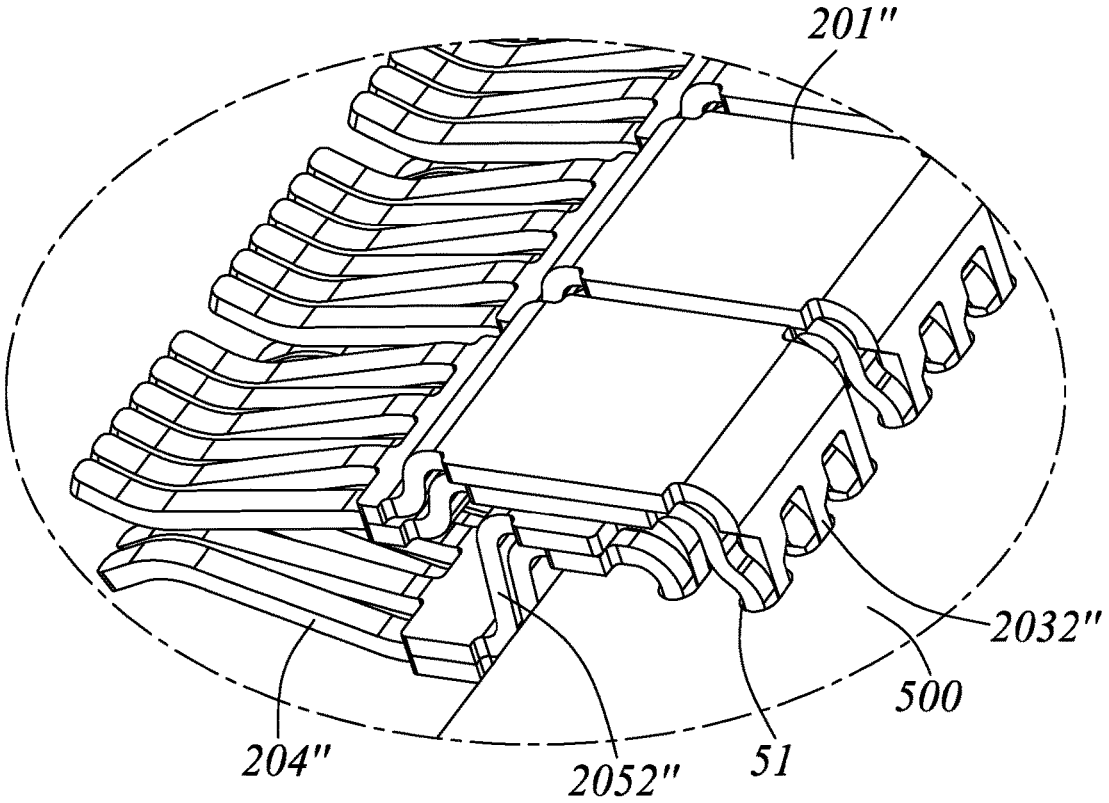
FIG. 22 is a schematic view of power contact pairs of the electrical connector installed on a printed circuit board shown in FIG. 18.
Figure 23:
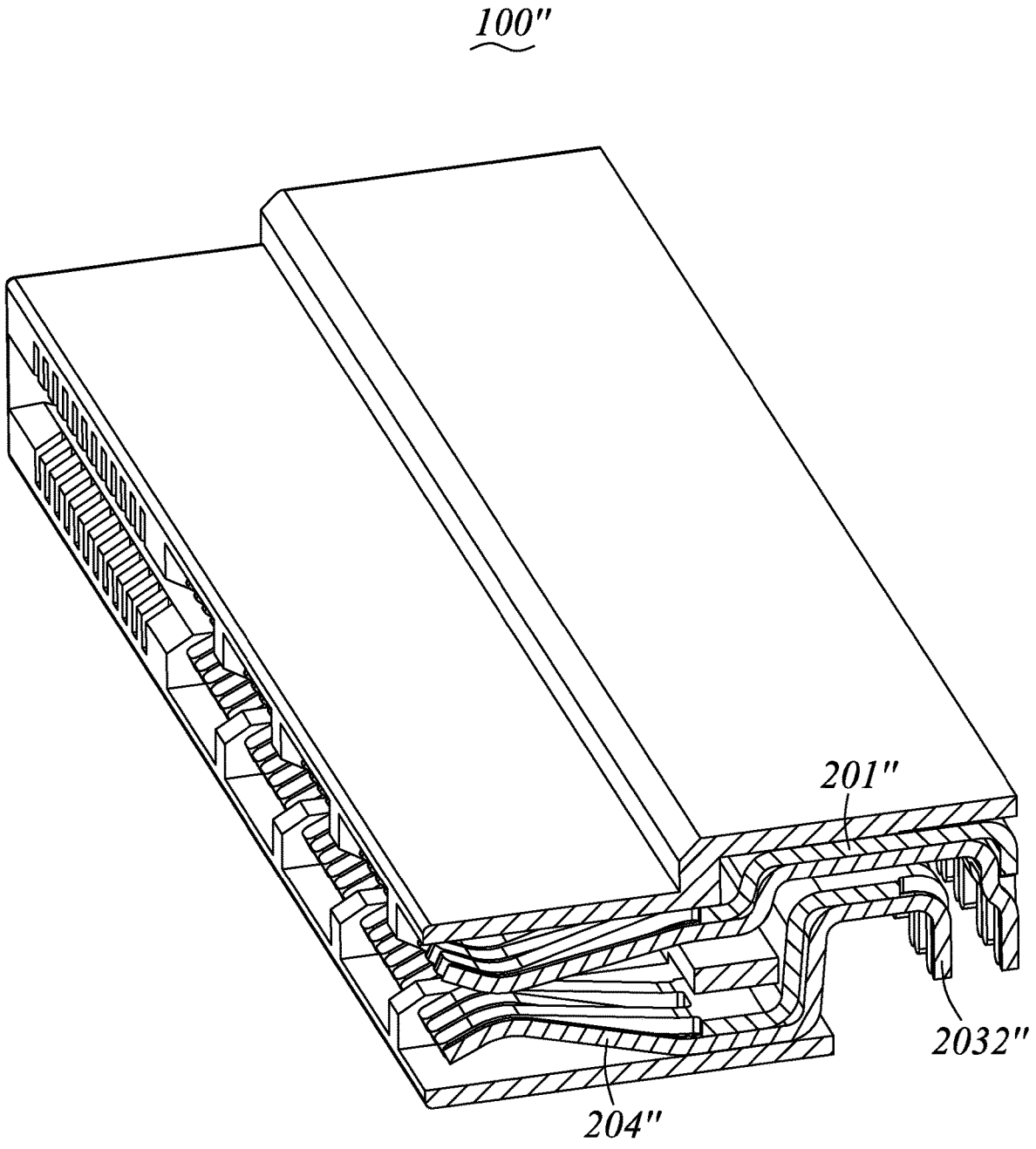
FIG. 23 is a cross-section view of the electrical connector shown in FIG. 14.

Referring to FIGS. 19-20 and conjunction with FIGS. 24-25, above all, in the third and fourth embodiments, the two welding legs 2032'', 2032''' in each welding leg group are arranged abreast along the transverse direction or the front-and-back direction. Welding legs 2032'', 2032''' of two power contacts 21'', 21''' in each power contact pair 2'', 2''' are arranged with a one-to-one correspondence, and every two corresponding welding legs 2032'', 2032''' are juxtaposed and constituting the welding leg group for inserting into a same through hole of the printed circuit board 500, thus the installation of the electrical connector assembly is simplified and the height and longitudinal dimensions of the electrical connector assembly can be effectively controlled. Additionally, the contacting portions of two power contacts 21'', 21''' in each power contact pair 2'', 2''' are arranged alternately and cyclically, thereby effectively increasing the current channel and reducing the heating of the power contact pairs 2'', 2''', and then improving the transmission reliability of electrical connector 100''.

FIGS. 26-29 illustrate an electrical connector 100'''' according to a fifth embodiment of the present invention, and the electrical connector 100'''' comprises an insulative housing 1'''', a plurality of power contact pairs 2'''' and signal contacts 3'''' retained in the insulative housing 1''''. The insulative housing 1'''' and power contact pairs 2'''' of the electrical connector 100'''' in the fifth embodiment of the present invention are similar or same as that of the first embodiment, so the description for them is omitted here for the fifth embodiment. The difference is as follows:

First heat radiating channels 171'''' of the insulative housing 1'''' are arranged in a front segment of a top wall 17'''', each first heat radiating channel 171'''' extends along a front-and-back direction to form a strip shape, and is located above the corresponding contacting portion 202'''' to expose the contacting portion 202'''' outwardly. The top wall 17'''' further has a plurality of cutouts 172'''' in a rear segment thereof, and the cutouts 172'''' are communicated with corresponding first contact-receiving passageway. A rear section of each power contact pairs 2'''' is exposed in relative cutout 172''''.

An outer contact 211'''' of each power contact pair 2'''' comprises a plurality of contacting portions 202'''' and a plurality of base portions 208'''' in front of contacting arms 204'''', one contacting portion 202'''' and one base portion 208'''' are extending forwards from each contacting arm 204'''', and the base portion 208'''' is located on one side of the contacting portion 202'''' in a transverse direction. In this embodiment, each contacting portion 202'''' of the outer contact 211'''' is tearing downwards from a lateral side of the corresponding base portion 208'''', and arched inwards so that the contacting areas 2020'''' of the outer contact 211'''' is roughly aligned with the contact area 2020'''' of the corresponding inner contact 21''''.

Furthermore, in this embodiment, the contacting areas 2020'''' of the outer contact 211'''' and the contacting areas 2020'''' of the inner contact 212'''' are misaligned in the front-and-back direction. In further, as shown in FIG. 29, in each power contact pair 2'''' along the front-and-back direction, the contacting areas 2020'''' of the outer contact 211'''' are placed behind the contacting areas 2020'''' of the inner contact 212''''.

Figure 29:
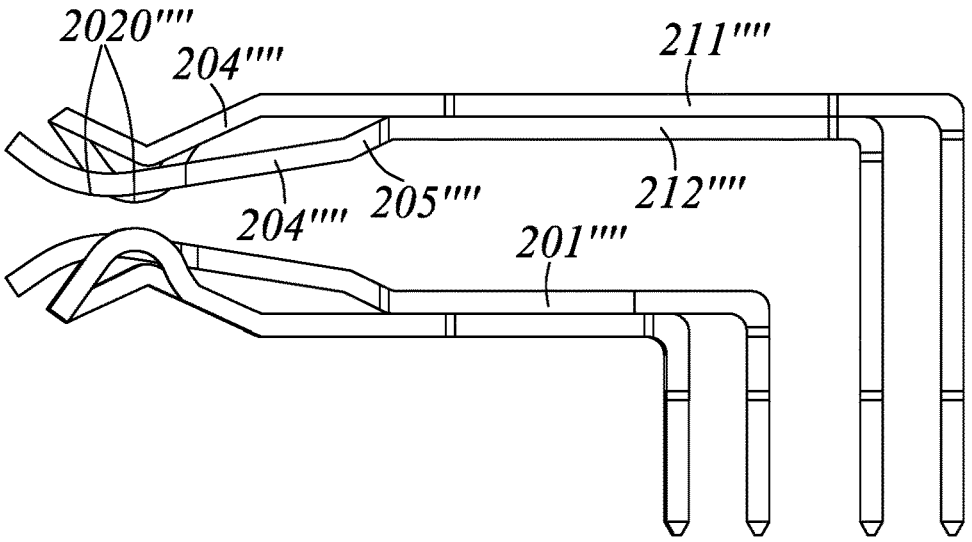
FIG. 29 is a side view of the group of power contact pairs shown in FIG. 27.

Referring to FIG. 29, each inner contact 212'''' also has a plurality of contacting arms 204'''' and a plurality of connecting arms 205'''' connecting the contacting arms 204'''' with a retaining portion 201''''. The angle between each contacting arm 204'''' of the outer contact 211'''' and a horizontal plane is greater than the angle between each contacting arm 204'''' of the relative inner contact 212'''' and the horizontal plane.

In addition, the contacting arms 204'''' and the connecting arms 205'''' of each inner contact 212'''' are extending along a front-to-back direction with an upward tendency. However, the angle between each contacting arm 204'''' of the inner contact 212'''' and a horizontal plane is different from the angle between each connecting arm 205'''' and the horizontal plane. In further, the angle between each connecting arm 205'''' of the inner contact 212'''' and a horizontal plane is greater than the angle between each contacting arm 204'''' and the horizontal plane.

While the electrical connector 100'''' not mating with the complementary member, the contacting areas 2020'''' of the outer contacts 211'''' are located on an interior side of the contacting areas 2020'''' of the corresponding inner contacts 212''''; and while the electrical connector 100'''' mating with the complementary member, the contacting areas 2020'''' of the power contact pairs 2'''' in a same row are located on a same horizontal plane.

Additionally, the outer contact 211'''' and the inner contact 212'''' in each power contact pair 2'''' are arranged along the height direction, and have a fixing structure that combine with each other so that the outer contact 211'''' and the inner contact 212'''' stack fixedly. In this embodiment, the fixing structure comprises a convex portion 2112'''' and a positioning slot 2121'''' coupling with each other, further, each outer contact 211'''' has at least one convex portion 2112'''' protruding towards the relative inner contact 212'''', and each inner contact 212'''' defines at least positioning slot 2121'''' for the corresponding convex portion 2112'''' being inserted and retained in. In other embodiments, the fixing structure of the outer contact 211'''' and the inner contact 212'''' also can be defined by transposition.

The electrical connector 100'''' further has a positioning seat 4'''' that can fix the power contact pairs 2'''' and signal contacts 3'''' in the insulative housing 1'''' simultaneously, and the positioning seat 4'''' is elongated and has a number of through slot 41'''' for welding legs 2032'''' and soldering leg 33'''' passing through.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing having a plurality of contact-receiving passageways extending along a front-and-back direction;

a plurality of power contact pairs mounted in the corresponding contact-receiving passageways of the insulative housing and divided into two opposite rows in a height direction according to contacting portions, and each power contact pair in each row having a first power contact and a second power contact, each one of the first power contact and the second power contact defining a flaky retaining portion held in the relative contact-receiving passageway and a number of contacting portions extending forwards from a front end of the retaining portion; wherein a gap is formed between two adjacent contacting portions of the first power contact, and at least a part of one contacting portion of the second power contact extends through the gap of the first power contact.

2. The electrical connector as claimed in claim 1, wherein the power contact pairs are arranged in pairs along the height direction to form a group, the contacting portions of two power contact pairs in each group are opposite to each other in the height direction and arranged at intervals.

3. The electrical connector as claimed in claim 2, wherein the contacting portions of the power contact pairs in a same row are arranged in two staggered columns along the front-and-back direction.

4. The electrical connector as claimed in claim 3, wherein each contacting portion is curved and has a contacting area protruding towards an interval wall of the insulative housing.

5. The electrical connector as claimed in claim 4, wherein the contacting areas of the power contact pairs in a same row are located on a same horizontal plane when mating with a complementary member.

6. The electrical connector as claimed in claim 3, wherein two neighboring contacting portions in a same row are staggered in the front-and-back direction.

7. The electrical connector as claimed in claim 2, wherein the two power contacts in each power contact pair are defined as an outer contact and an inner contact respectively, the retaining portions of two power contacts in each power contact pair are arranged along the height direction, and inserted into a same contact-receiving passageway from a rear side of the main section.

8. The electrical connector as claimed in claim 7, wherein each power contact has a plurality of elastic contacting arms extending forwards from the retaining portion, the angle between each contacting arm of the outer contact and a horizontal plane is greater than the angle between each contacting arm of the relative inner contact and the horizontal plane.

9. The electrical connector as claimed in claim 7, wherein in an up-to-down direction, the lengths of the retaining portions of four power contacts in each group of power contact pairs in the front-and-back direction are decreased successively.

10. The electrical connector as claimed in claim 7, wherein the insulative housing is provided with a number of first heat radiating channels in a top wall thereof, the first heat radiating channels are penetrating through the top wall in the height direction and communicated with the relative contact-receiving passageways on an inner side thereof.

11. The electrical connector as claimed in claim 10, wherein each first heat radiating channel extends along the front-and-back direction to form a strip shape, and is located above the corresponding contacting portion to expose the contacting portion outwardly.

12. The electrical connector as claimed in claim 10, wherein the top wall is provided with two rows of first heat radiating channels in the front-and-back direction, and a front row of the first heat radiating channels are disposed in the mating section for exposing the contacting portions, a rear row of the first heat radiating channels are defined in the main section for exposing the retaining portion.

13. The electrical connector as claimed in claim 12, wherein at least an upper power contact in each power contact pair has at least one second heat radiating channel, the second heat radiating channel is defined in a retaining portion and penetrating through the retaining portion along the height direction.

14. The electrical connector as claimed in claim 7, wherein the outer contact of each power contact pair comprises a plurality of contacting portions and a plurality of base portions in front of contacting arms, one contacting portion and one base portion are extending forwards from each contacting arm, and the base portion is located on one side of the contacting portion in a transverse direction.

15. The electrical connector as claimed in claim 7, wherein the retaining portions of two power contacts in each power contact pair are stacked with each other along the height direction.

16. The electrical connector as claimed in claim 2, wherein each soldering portion comprises a plurality of welding legs extending along the height direction, and welding legs of two power contacts in each power contact pair are arranged with a one-to-one correspondence, every two corresponding welding legs in each power contact pair are juxtaposed and constituting a welding leg group.

17. The electrical connector as claimed in claim 15, wherein two welding legs in each welding leg group are arranged abreast along a transverse direction or the front-and-back direction, and a gap is formed between two welding legs in each welding leg group, in an arrangement direction of the two welding legs in each welding leg group, an extending dimension of each welding leg is less than four times of a width of the gap.

18. The electrical connector as claimed in claim 17, wherein the width of the gap between two welding legs in each welding leg group is in the range of 0.1 mm to 0.5 mm, and the extending dimension of each welding leg is in the range of 0.4 mm to 0.64 mm.

19. An electrical connector, comprising:

an insulative housing having a plurality of contact-receiving passageways extending along a front-and-back direction; and a plurality of power contact pairs mounted in the corresponding contact-receiving passageways, and each power contact pair having two power contacts, each power contact defining a flaky retaining portion held in the relative contact-receiving passageway, a number of contacting portions extending forwards from a front end of the retaining portion and a soldering portion extending from a rear end of the retaining portion; wherein one of two neighboring contacting portions has a projection on a vertical plane at least partially overlapped with that of the other of two neighboring contacting portions.

20. An electrical connector assembly, comprising:

an insulative housing having two rows of contact-receiving passageways separating from each other via a transverse interval wall, and each contact-receiving passageway extending along a front-and-back direction; and a plurality of power contact pairs mounted in the corresponding contact-receiving passageways, and each power contact pair having two power contacts, each power contact defining a flaky retaining portion held in the relative contact-receiving passageway, a number of contacting portions extending forwards from the retaining portion and a soldering portion extending from a rear end of the retaining portion, each contacting portion having a contacting area protruding towards the interval wall; wherein the contacting areas of the two power contacts in each power contact pair are arranged in a misaligned relationship along the front-and-back direction.

* * * * *